US005887214A

United States Patent [19]

Kuriu et al.

[11] Patent Number: 5,887,214

[45] Date of Patent: Mar. 23, 1999

[54] APPARATUS FOR PROCESSING PHOTOSENSITIVE MATERIAL

[75] Inventors: Sadao Kuriu; Kyonosuke Yamamoto; Jun Urasaki; Yoshikazu Takano; Tsuyoshi Harada; Akira Kunihiro; Kunihiro Tanabe, all of Tokyo; Eiji Miyasaka, Shiga; Masaharu Kimura, Shiga; Yasuhiro Kawaguchi, Shiga; Fumito Fukuhara, Shiga, all of Japan

[73] Assignees: Mitsubishi Paper Mills Limited, Tokyo; Dainippon Screen Mfg. Co., Ltd., Kyoto, both of Japan

[21] Appl. No.: 910,157

[22] Filed: Aug. 13, 1997

[30] Foreign Application Priority Data

| | | | |
|---|---|---|---|
| Aug. 14, 1996 | [JP] | Japan | 8-233646 |
| Aug. 14, 1996 | [JP] | Japan | 8-233654 |
| Aug. 14, 1996 | [JP] | Japan | 8-233655 |
| Aug. 14, 1996 | [JP] | Japan | 8-233656 |
| Aug. 14, 1996 | [JP] | Japan | 8-233657 |
| Aug. 14, 1996 | [JP] | Japan | 8-233658 |

[51] Int. Cl.[6] ..... G03D 5/06

[52] U.S. Cl. ..... 396/608; 396/606; 118/261

[58] Field of Search ..... 396/606, 607, 396/608, 611; 118/261

[56] References Cited

U.S. PATENT DOCUMENTS

| | | | |
|---|---|---|---|
| 3,396,648 | 8/1968 | Chen et al. | 396/606 |
| 3,940,782 | 2/1976 | Neeb et al. | 396/608 |
| 4,299,472 | 11/1981 | Seelenbinder et al. | 396/606 |
| 4,327,987 | 5/1982 | Friar et al. | 396/606 |
| 4,945,934 | 8/1990 | Vaughan | 396/604 |
| 5,349,412 | 9/1994 | Miyasaka | 396/544 |
| 5,398,092 | 3/1995 | Tanno et al. . | |

FOREIGN PATENT DOCUMENTS

| | | |
|---|---|---|
| 0 026 900 | 4/1981 | European Pat. Off. . |
| 0 488 207 | 6/1992 | European Pat. Off. . |
| 62-237455 | 10/1987 | Japan . |
| 63-132241 | 6/1988 | Japan . |
| 63-202750 | 8/1988 | Japan . |
| 63-261263 | 10/1988 | Japan . |
| 63-282740 | 11/1988 | Japan . |
| 64-90450 | 4/1989 | Japan . |
| 5-297598 | 11/1993 | Japan . |

*Primary Examiner*—Alan A. Mathews
*Attorney, Agent, or Firm*—McDermott, Will & Emery

[57] ABSTRACT

The apparatus for coating a photosensitive material (M) with a processing liquid comprises an activator coating mechanism (43) for metering a constant amount of activator to apply the metered activator to the photosensitive surface of the photosensitive material fed by the pair of introduction rollers. The activator is supplied form a plurality of discharge holes (121) bored in a pipe (122) and is once received by a receiving portion (124). The activator is diffused horizontally and flows downwardly through a plurality of openings (123) bored at the bottom of the receiving portion onto a coating roller (125). The activator is diffused again at the contact between the coating roller and a diffusion film (126) and is coated to the photosensitive material by the coating roller.

19 Claims, 15 Drawing Sheets

APPARATUS FOR PROCESSING PHOTOSENSITIVE MATERIAL

BACKGROUND OF THE INVENTION

1. Field of the Invention

The present invention relates to an apparatus for processing a photosensitive material with a processing liquid.

2. Description of the Background Art

Photosensitive materials, such as photosensitive films, photographic paper, printing plates and the like, on which images have been recorded are processed with a processing liquid such as activator, fixing solution, stabilizer, and rinsing water. Apparatuses for performing such processes upon photosensitive materials include a known dip-type processing apparatus wherein the photosensitive materials are fed into a processing tank storing a processing liquid by feeding means comprising pairs of feed rollers and the like and then dipped in the processing liquid, thereby subjected to processing.

Such an dip-type processing apparatus requires a great amount of processing liquid to dip the photosensitive materials therein. In the dip-type processing apparatus, the processing liquid is deactivated due to repeated processings for many photosensitive materials or developing degradation with time resulting from carbon dioxide and oxygen in the atmosphere. The processing liquid is recovered from the deactivation by adding a replenisher fluid to the processing liquid. This causes a difference between the ingredients of the processing liquid when the process starts and the ingredients of the processing liquid after a certain amount of process continues, failing to achieve exactly uniform processing.

To solve the problem, a coat-type photosensitive material processing apparatus has been used for coating a photosensitive surface of the photosensitive material with the processing liquid in amounts required to process the photosensitive material to perform processing in place of dipping the photosensitive material in the processing liquid. An example of the coat-type processing apparatus known in the art is such that the processing liquid is discharged from a processing liquid supply nozzle having a plurality of processing liquid discharge holes onto a roller (referred to hereinafter as a "roughened roller") having a surface roughened by forming grooves therein, and the roughened roller is rotated in contact with the photosensitive material, whereby the processing liquid is applied to the photosensitive material through the roughened roller.

In the background art processing apparatus, a pump for supplying the processing liquid by the application of pressure is used to force the processing liquid from a processing liquid tank storing the processing liquid into a processing liquid supply pipe having a plurality of processing liquid discharge holes. Since the pump is required to correctly supply a small constant amount of processing liquid per unit time, a pump for generating pulsation (referred to hereinafter as a "pulsation pump" in the present application) such as a peristaltic pump, an oscillating pump, and a bellows pump is used.

The background art apparatus has drawbacks to be described below.

1) For example, in the process step of coating a stabilizer to stabilize a lithographic printing plate employing a silver complex salt diffusion transfer reverse method (DTR method) after the development of the lithographic printing plat, the photosensitive layer of the photosensitive material has been swelled by the activator in the development step. When the swelled photosensitive material contacts the roughened roller of the background art apparatus, the photosensitive surface of the photosensitive material is damaged.

2) The coat-type processing apparatus preferably uses a minimum amount of processing liquid in terms of running costs required for processing and environmental issues. However, supply of a small amount of processing liquid to the processing liquid supply nozzle makes it difficult for the background art apparatus to provide a uniform amount of processing liquid discharged from the processing liquid discharge holes to the roughened roller, accordingly resulting in a non-uniform amount of processing liquid applied to the photosensitive material. This phenomenon is liable to occur particularly in the leading edge portion of the photosensitive material.

Additionally, the use of the lithographic printing plate employing the silver complex salt diffusion transfer reverse method (DTR method) wherein development proceeds rapidly as the photosensitive material not only makes the above described drawback pronounced but also decreases printing performance, particularly the plate life, which is a problem inherent in the lithographic printing plate.

3) A processing liquid supply apparatus employing the pulsation pump repeats a discharging state wherein the processing liquid is discharged from the processing liquid discharge holes and a non-discharging state wherein the processing liquid is not discharged as the processing liquid delivered from the pulsation pump produces a pulsating flow. In the non-discharging state of the processing liquid, air is sometimes drawn into the processing liquid supply pipe through such a processing liquid discharge hole in the reverse direction to form an air bubble in the processing liquid supply pipe. If such a bubble in the processing liquid supply pipe is greater in size than the processing liquid discharge hole, the surface tension of the processing liquid defining the bubble causes the bubble to block the processing liquid discharge hole to preclude the processing liquid to pass through the discharge hole. This results in a non-uniform amount of processing liquid discharged from the plurality of processing liquid discharge holes of the processing liquid supply pipe.

The non-uniform amount of processing liquid coating the photosensitive material creates processing unevenness of the developed photosensitive material. The occurrence of the processing unevenness is particularly pronounced in the lithographic printing plates utilizing the silver complex salt diffusion transfer reverse method (DTR method) in which development proceeds rapidly.

To solve this problem, there has been proposed a photosensitive material processing apparatus wherein the processing liquid is supplied from a slit opening formed between a pair of sheets to a processing liquid coating portion comprising a pair of non-rotatable rod-shaped members and the photosensitive material is passed through a puddle of processing liquid stored between the pair of rod-shaped members whereby the processing liquid is applied to the photosensitive material.

This photosensitive material processing apparatus is capable of relatively uniformly supplying a small amount of processing liquid. In this case, however, the amount of processing liquid coating the photosensitive material depends on the amount of processing liquid supplied to between the pair of rod-shaped members. Thus, the attempt to coat the entire photosensitive material with an exactly uniform amount of processing liquid has an inevitable limitation.

4) In the coat-type photosensitive material processing apparatus, when a puddle of processing liquid having a sufficient volume is not formed between the roughened roller and a support roller prior to the application of the processing liquid to the photosensitive material, processing unevenness resulting from the shortage of the processing liquid occurs particularly in a leading edge portion of the photosensitive material.

5) The coat-type photosensitive material processing apparatus is intended to promote processing by supplying the processing liquid from a processing liquid tank for storing the processing liquid heated to a predetermined temperature to a processing liquid coating portion for coating the photosensitive material with the processing liquid to apply the heated processing liquid to the photosensitive material. At the start of coating of the photosensitive material, the temperatures of a feed passage of the processing liquid from the processing liquid tank to the processing liquid coating portion and the temperatures of the above described roughened roller and support roller have been decreased to room temperature. This decreases the temperature of the processing liquid to be applied to the photosensitive material through the processing liquid feed passage, resulting in processing unevenness.

6) In the coat-type processing apparatus employing the roughened roller, contaminants such as silver sludge (referred to hereinafter as "silver sludge and the like") are produced from the processing liquid when the processing liquid is continuously applied to the photosensitive material. The silver sludge and the like is deposited in recesses, such as grooves, of the roughened roller.

In the presence of the silver sludge and the like covering the recesses, such as grooves, of the roughened roller, the decrease in the amount of processing liquid to be applied to the photosensitive material causes the shortage or non-uniformity of the amount of processing liquid to be applied to the photosensitive material. The shortage or non-uniformity of the processing liquid to be applied to the photosensitive material results in the processing unevenness of the developed photosensitive material and the reduction in plate life in printing using the photosensitive material. Such phenomena are particularly pronounced when the lithographic printing plate employing the silver complex salt diffusion transfer reverse method (DTR method) wherein development proceeds rapidly is used as the photosensitive material.

Thus, an operator must repeatedly clean the roughened roller to remove the silver sludge and the like deposited on the roughened roller.

SUMMARY OF THE INVENTION

The present invention is directed to an apparatus for processing a photosensitive material.

According to the present invention, the apparatus comprises: processing liquid discharge means for discharging a processing liquid to a predetermined flow path; coating means for receiving the processing liquid from the flow path to coat the photosensitive material with the processing liquid; first processing liquid diffusion means provided in the flow path for receiving the processing liquid from the processing liquid discharge means to diffuse the processing liquid and to cause the processing liquid to flow downwardly; and second processing liquid diffusion means having a contact member in contact with the coating means for receiving the processing liquid from the first processing liquid diffusion means to diffuse the processing liquid again and to cause the processing liquid to flow downwardly along the coating means.

The two-stage diffusion of the processing liquid is effective to coat the photosensitive material with a uniform layer of the processing liquid.

Preferably, the coating means comprises a coating roller having a circumferential surface on which a plurality of grooves are formed along a circumferential direction of the coating roller, and the processing liquid flows downwardly through the plurality of grooves.

The processing liquid is metered by the plurality of grooves and a constant amount of the processing liquid can be applied to the photosensitive material.

In a preferred embodiment of the present invention, the first processing liquid diffusion means comprises a processing liquid receiving member through which a plurality of through holes are formed. The processing liquid flows downwardly through the plurality of through holes, and the plurality of through holes are arranged at a pitch greater than a pitch at which the plurality of grooves are arranged.

In an aspect of the present invention, the sum of the cross-sectional areas of the plurality of through holes is greater than the sum of the cross-sectional areas of the plurality of grooves.

The apparatus may further comprises anti-backflow means in contact with the coating roller for preventing the processing liquid from flowing against rotation of the coating roller.

In another aspect of the present invention, an apparatus for processing a photosensitive material comprises: processing liquid discharge means for discharging a processing liquid; a coating roller having a rough surface for contacting a photosensitive surface of the photosensitive material to apply the processing liquid to the photosensitive surface; an elastic contact member in contact with the coating roller; processing liquid supply means for supplying the processing liquid to a contact space between the coating roller and the contact member to form a puddle of processing liquid between the contact space, the puddle of processing liquid extending in an axial direction of the coating roller; and a backup roller opposed to the coating roller for contacting a photo-insensitive surface of the photosensitive material, the photosensitive material being held between the coating roller and the backup roller.

In further another aspect of the present invention, an apparatus for processing a photosensitive material comprises: a coating roller in contact with a photosensitive surface of the photosensitive material for applying a processing liquid to the photosensitive surface; a contact member having an uneven surface which has ups and downs in an axial direction of the coating roller and in contact with the coating roller; processing liquid supply means for supplying the processing liquid to a contact space between the coating roller and the contact member; and support means opposed to the coating roller and in contact with a photo-insensitive surface of the photosensitive material for supporting the photoinsensitive surface.

Accordingly, an object of the present invention to uniformly coat a photosensitive material with a proper amount of processing liquid without damages to the photosensitive material.

It is another object of the present invention to prevent air from entering a processing liquid discharge portion to allow the processing liquid discharge portion to uniformly discharge a processing liquid.

It is a further object of the present invention to coat a photosensitive material with a processing liquid by passing the photosensitive material through a puddle of processing liquid wherein the puddle of processing liquid is formed in a sufficient volume to prevent processing unevenness of the photosensitive material.

It is a still further object of the present invention to maintain a suitable temperature of the processing liquid to be applied to the photosensitive material even at the start of the coating of the photosensitive material with the processing liquid, to prevent the processing unevenness of the photosensitive material.

It is another object of the present invention to remove such materials as silver sludge deposited on a roughened surface of a coating roller by a backup roller to maintain a constant amount of processing liquid for coating and to facilitate maintenance.

It is still another object of the present invention to perform high-quality processing free of development unevenness over the photosensitive material when a small amount of processing liquid is used.

These and other objects, features, aspects and advantages of the present invention will become more apparent from the following detailed description of the present invention when taken in conjunction with the accompanying drawings.

DESCRIPTION OF THE PREFERRED EMBODIMENTS

A. General Structure of Apparatus

Figure 1:
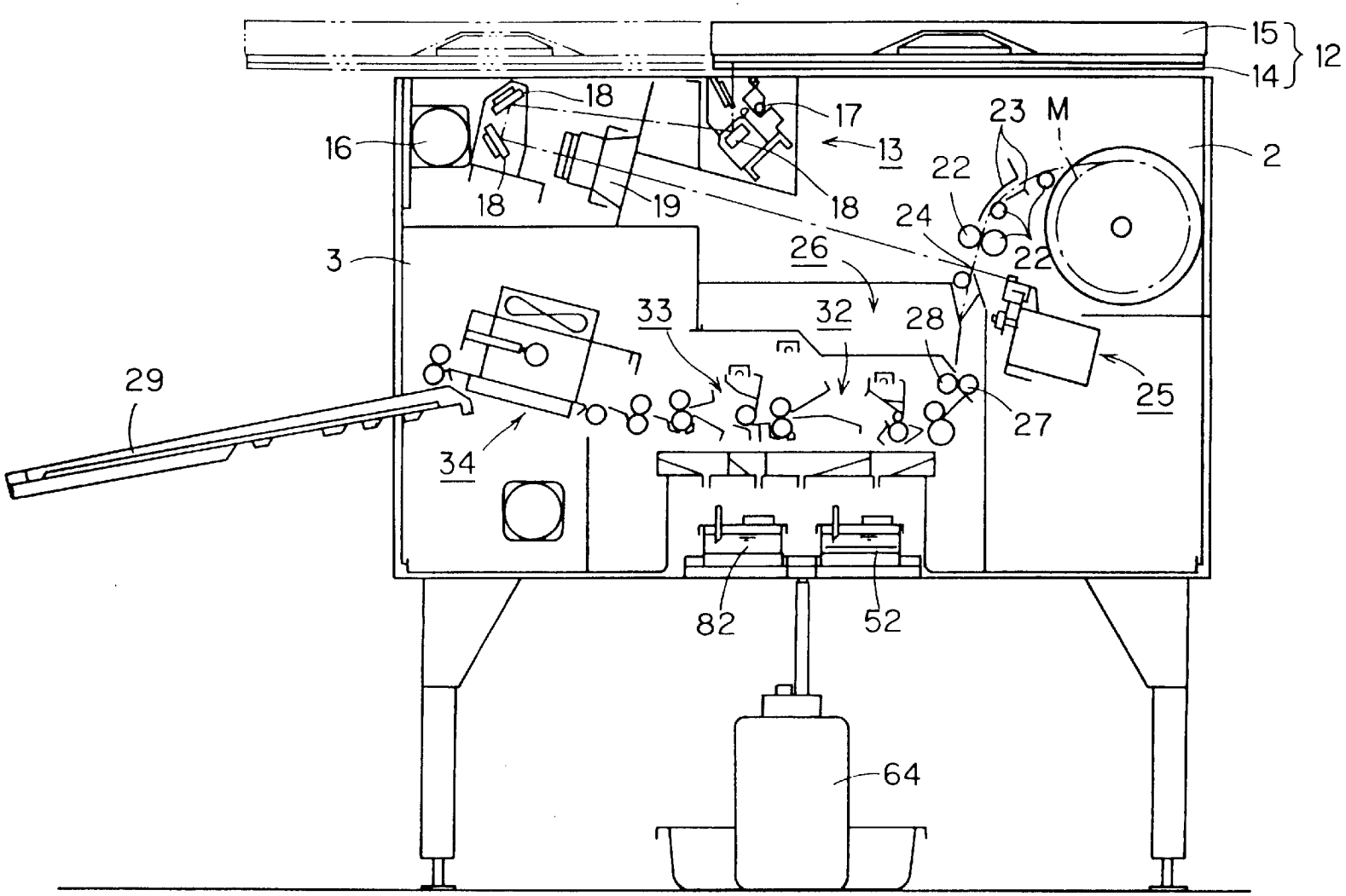
FIG. 1 is a schematic view of a plate making apparatus for lithographic printing plates according to a preferred embodiment of the present invention.

FIG. 1 is a schematic view of a plate making apparatus for lithographic printing plates, which comprises a photosensitive material processing apparatus according to the present invention.

The plate making apparatus employs a lithographic printing plate M using a silver complex salt diffusion transfer reverse method (DTR method) as a photosensitive material, and performs image exposure and development on the lithographic printing plate M. The plate making apparatus comprises an exposure unit 2 for exposing the lithographic printing plate M, and a development unit 3 for developing the exposed lithographic printing plate M.

The lithographic printing plate using the silver complex salt diffusion transfer reverse method (DTR method), particularly the lithographic printing plate having a physical development nuclei layer on a silver halide emulsion layer, is disclosed in U.S. Pat. Nos. 3,728,114; 4,134,769; 4,160,670; 4,336,321; 4,501,811; 4,510,228; and 4,621,041. The exposed silver halide gives rise to chemical development upon the DTR development to change into black silver, forming a hydrophilic non-image area. A silver salt complexing agent in an activator changes unexposed silver halide crystal into silver complex which in turn is diffused to the physical development nuclei layer at the surface and gives rise to physical development because of the presence of nuclei to form an image area principally comprising ink-receptive physically developed silver.

The exposure unit 2 is described first. The exposure unit 2 projects light reflected from an original held by an original holder 12 onto a surface of the lithographic printing plate M by means of a projection optical system 13 to expose the lithographic printing plate M, thereby forming the image of the original on the lithographic printing plate M.

The original holder 12 includes a transparent plate 14 for placing the original thereon, and a top cover 15 which is operable and closable relative to the transparent plate 14, and is movable horizontally in reciprocal manner between a position indicated by the solid lines of FIG. 1 and a position indicated by the alternate long and two short dash lines of FIG. 1 while holding the original by driving a motor 16. The projection optical system 13 is fixed under the path of reciprocal movement of the original holder 12, and includes a rod-shaped light source 17 for directing illumination light onto the surface of the original held by the original holder 12 and moving in the horizontal direction, a plurality of reflecting mirrors 18 for guiding the light emitted from the light source 17 and reflected from the original, and a projection lens 19 for projecting the light guided by and reflected from the plurality of reflecting mirrors 18 onto the lithographic printing plate M.

The exposure unit 2 exposes the lithographic printing plate M to form the original image to the lithographic printing plate M in a manner to be described below. Initially, the original holder 12 is located in the position indicated by the solid lines of FIG. 1. The original is placed on the transparent plate 14, with the top cover 15 opened, and the top cover 15 is then closed to hold the original in the original holder 12. With the light source 17 remains on, the original holder 12 is moved leftwardly as shown in FIG. 1. In synchronism with the leftward movement of the original holder 12, a plurality of feed rollers 22 and a plurality of guide members 23 feed the leading edge of the rolled lithographic printing plate M at the same velocity as the original holder 12 being moved. Then, the original held by the original holder 12 sequentially receives light illumination from the light source 17. The light reflected from the original is directed through the plurality of reflecting mirrors 18 and the projection lens 19 onto the surface of the lithographic printing plate M moving at the same velocity as the original holder 12 being moved to expose the lithographic printing plate M, thereby forming a latent original image to the lithographic printing plate M.

The exposed lithographic printing plate M to which the latent image is formed is fed from the exposure unit 2 to the development unit 3 in the latter stage, and processed in the development unit 3. A cutting unit 25 provided adjacent the outlet of the exposure unit 2 includes a cutter 24 movable in the direction perpendicular to a forward direction (feed direction) of the lithographic printing plate M, and cuts the lithographic printing plate M at the rear end where the exposure ends.

The lithographic printing plate M is not permitted to simply travel from the exposure unit 2 to the development unit 3 since the velocity at which the lithographic printing plate M is fed in the exposure unit 2 is lower than the velocity at which the lithographic printing plate M is fed in the development unit 3. Further, the feeding operation of the lithographic printing plate M must be suspended when the cutting unit 25 cuts the lithographic printing plate M. For these reasons, a buffer portion 26 for the lithographic printing plate M is provided between the exposure unit 2 and the development unit 3. A pair of rollers 27 and 28 in the buffer portion 26 stop rotating for a given period of time during the feeding operation of the lithographic printing plate M which has been exposed in the exposure unit 2 to store a given length of the lithographic printing plate M in the buffer portion 26 prior to the feeding operation of the lithographic printing plate M to the development unit 3.

B. Overview of Development Unit 3

B-1. Structure of Development Unit 3

Figure 2:
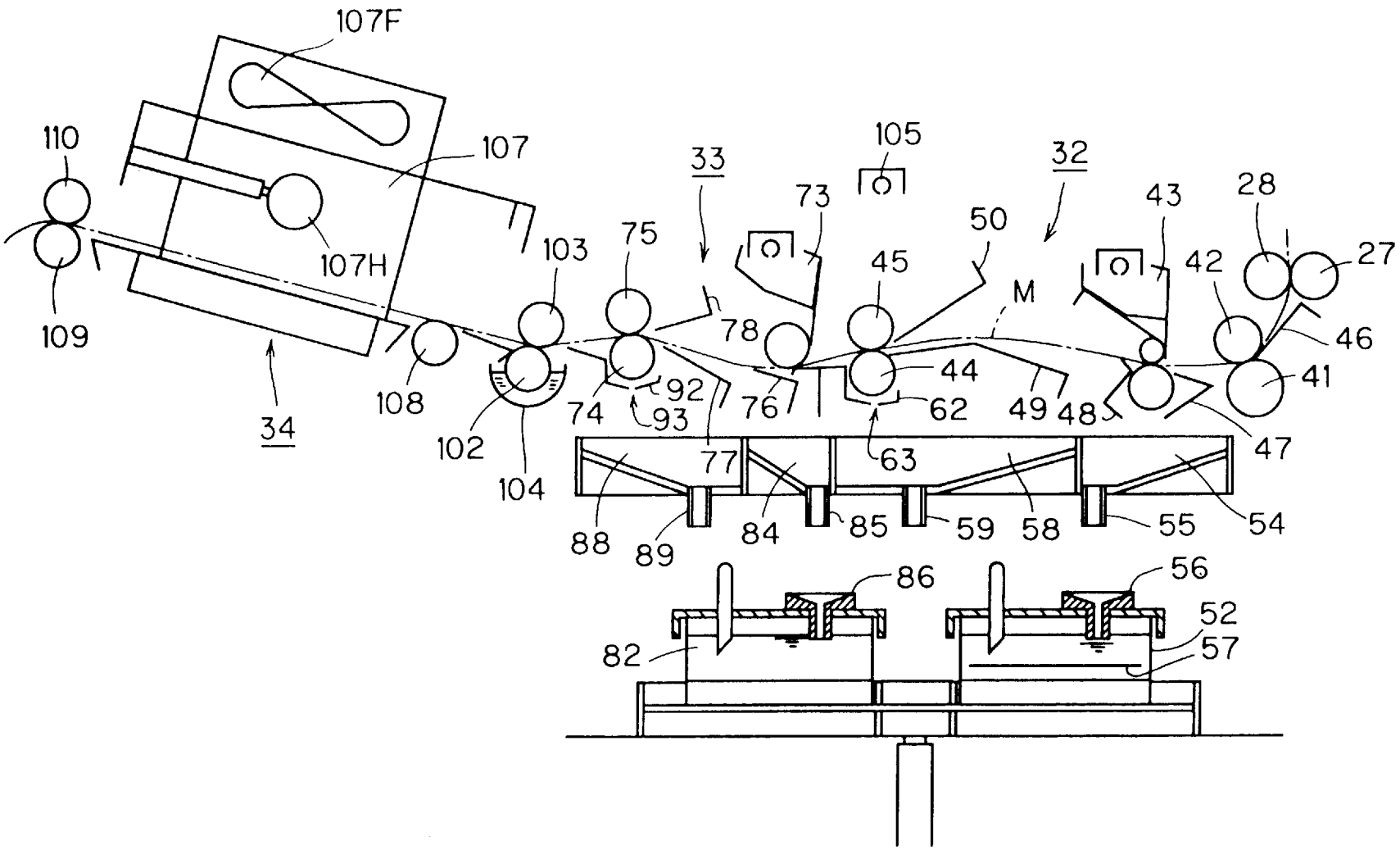
FIG. 2 is a schematic view of a development unit.
Figure 3:
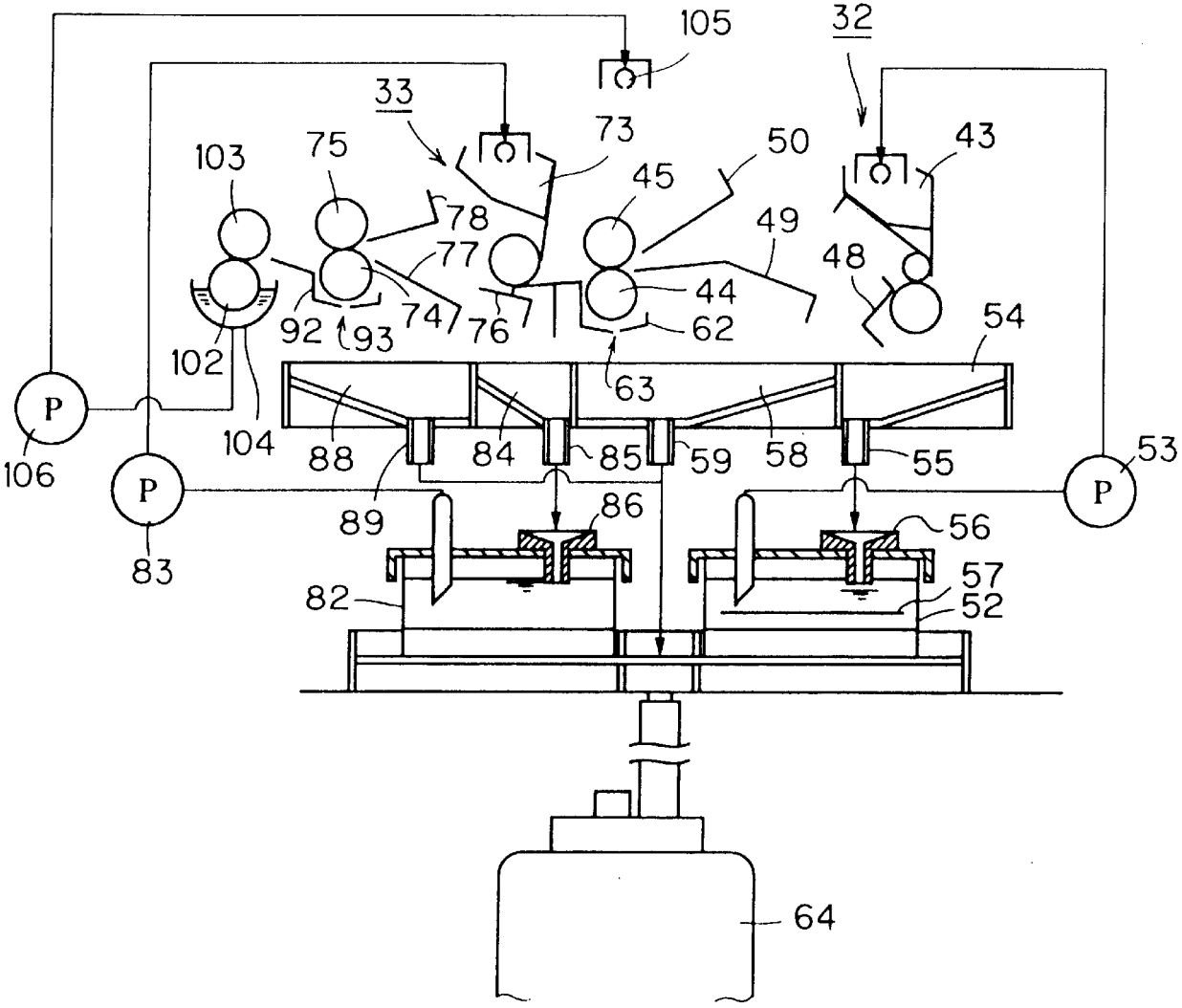
FIG. 3 is a schematic view of a piping system for the development unit.

The structure of the development unit 3 according to the present invention is discussed hereinafter. FIG. 2 is an enlarged schematic view of the development unit 3 shown in FIG. 1. FIG. 3 is a schematic view of a piping system for the development unit 3.

The development unit 3 comprises a development portion 32 for coating the exposed lithographic printing plate M with an activator to develop the exposed lithographic printing plate M, a stabilization portion 33 for coating the developed lithographic printing plate M with a stabilizer to stabilize the developed lithographic printing plate M, and a drying portion 34 for drying the stabilized lithographic printing plate M.

B-2. Development Portion 32

The development portion 32 includes a pair of introduction rollers 41, 42 for feeding the lithographic printing plate M fed by the rollers 27 and 28 of the buffer portion 26 to the development portion 32 while holding the lithographic printing plate M therebetween; an activator coating mechanism 43 for metering a constant amount of activator to apply the metered activator to the photosensitive surface of the lithographic printing plate M fed by the pair of introduction rollers 41, 42; a pair of squeezing rollers 44, 45 for removing the activator provided for development from the lithographic printing plate M; and a plurality of guide members 46, 47, 48, 49, 50 for guiding the lithographic printing plate M.

The lower one 41 of the pair of introduction rollers 41, 42 is a heat roller containing a heater for heating the lithographic printing plate M passing therethrough. The lithographic printing plate M is preheated prior to development in order to prevent the temperature of a small amount of temperature-controlled activator contacting the lithographic printing plate M from decreasing because of the heat capacity of the lithographic printing plate M when the lithographic printing plate M is coated with the activator and developed.

Referring to FIG. 3, the activator coating mechanism 43 is connected to an activator tank 52 for storing the activator therein through a pump 53. A recovery tray 54 is provided under the activator coating mechanism 43. The activator in the activator tank 52 is delivered to the activator coating mechanism 43 under pressure by the pump 53 and fed onto the lithographic printing plate M. An amount of activator which has not coated the lithographic printing plate M, such as an amount of activator which flows out of opposite sides and rear end of the lithographic printing plate M, drops into the recovery tray 54. The dropped activator which is reusable drops through a recovery pipe 55 provided at the lower end of the recovery tray 54 into an activator receiving portion 56 of the activator tank 52 and is collected in the activator tank 52. The activator tank 52 contains a panel heater 57 to maintain a predetermined temperature of the activator circulating in the activator circulation passage extending from the activator tank 52 to the activator coating mechanism 43.

A recovery tray 58 is provided under the pair of squeezing rollers 44, 45. The fatigued activator removed from the lithographic printing plate M by the pair of squeezing rollers 44, 45 drops through a recovery hole 63 of an activator receiving member 62 provided under the pair of squeezing rollers 44, 45 into the recovery tray 58. The fatigued activator which is not reusable is discharged to a drain tank 64 through a recovery pipe 59 provided at the lower end of the recovery tray 58.

Figure 4:
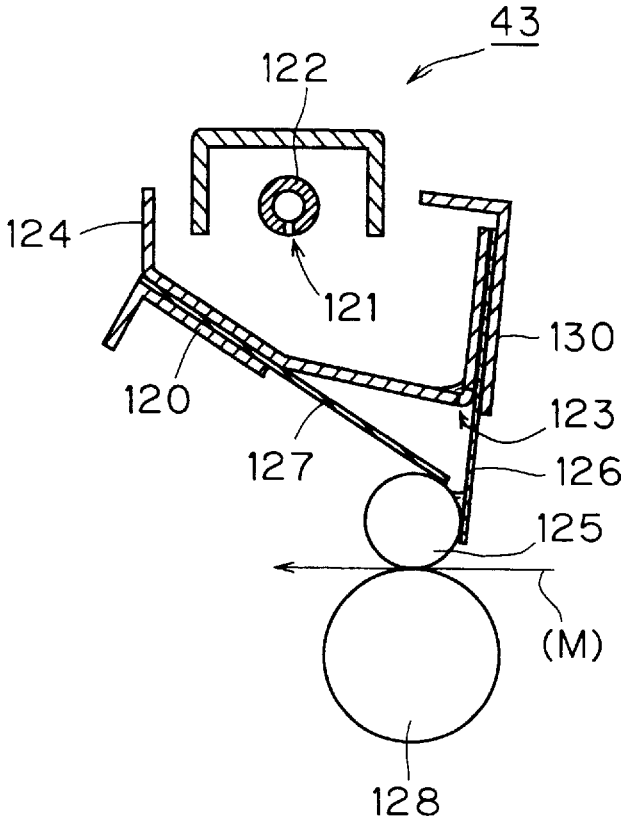
FIG. 4 is a schematic view of an activator coating mechanism.

With reference to FIG. 4, the activator coating mechanism 43 includes an activator supply pipe 122 having a plurality of discharge holes 121 bored through its lower position; an activator receiving portion 124 having a plurality of openings 123 bored through its lower end for allowing the activator to flow downwardly therethrough; and a coating roller 125 having a surface formed with a plurality of grooves and rotating in contact with the lithographic printing plate M. A diffusion film 126 guides the activator flowing down from the openings 123 of the activator receiving portion 124 to the coating roller 125. An anti-backflow film 127 prevents a backflow of the activator flowing down from the openings 123 of the activator receiving portion 124. A backup roller 128 is in contact with the coating roller 125. The arrow of FIG. 4 indicates the feed direction of the lithographic printing plate M.

The activator supply pipe 122 is connected to the above described activator tank 52 through the pump 53, and is driven by the pump 53 to discharge the activator through the plurality of discharge holes 121. The activator is received once in the activator receiving portion 124 and then flows downwardly through the plurality of openings 123 toward the diffusion film 126. The activator flowing downwardly through the openings 123 of the activator receiving portion 124 is stored once in a recess formed on a contact region between the coating roller 125 and the diffusion film 126 and is then diffused in the direction orthogonal to the feed direction of the lithographic printing plate M. Then, as the coating roller 125 rotates, the activator passes through openings defined by the grooves of the coating roller 125 toward a contact region between the coating roller 125 and the backup roller 128 to form a puddle of activator therein.

The activator is applied to the photosensitive surface of the lithographic printing plate M when the lithographic printing plate M passes through the puddle of activator. Since the backup roller 128 presses the photosensitive surface of the lithographic printing plate M against the surface of the coating roller 125, the openings defined by the grooves of the coating roller 125 meter a constant amount of the activator applied to the photosensitive surface of the lithographic printing plate M. Thus, the photosensitive surface of the lithographic printing plate M passed through the contact region between the backup roller 128 and the coating roller 125 is constantly coated with the constant amount of activator required for development.

B-3. Stabilization Portion 33

Referring again to FIG. 3, the stabilization portion 33 includes a stabilizer coating mechanism 73 for metering a constant amount of stabilizer to apply the metered stabilizer to the photosensitive surface of the lithographic printing plate M fed from the development portion 32 and a pair of squeezing rollers 74, 75 for removing the stabilizer provided for stabilization from the lithographic printing plate M. A plurality of guide members 76, 77, 78 are provided for guiding the lithographic printing plate M.

The stabilizer coating mechanism 73 is connected to a stabilizer tank 82 for storing the stabilizer therein through a pump 83. A recovery tray 84 is provided under the stabilizer coating mechanism 73. The stabilizer in the stabilizer tank 82 is delivered to the stabilizer coating mechanism 73 under pressure by the pump 83 and fed onto the lithographic printing plate M. An amount of stabilizer which has not coated the lithographic printing plate M, such as an amount of stabilizer which flows out of opposite sides and rear end of the lithographic printing plate M, is reusable and drops into the recovery tray 84. The dropped stabilizer drops through a recovery pipe 85 provided at the lower end of the recovery tray 84 into a stabilizer receiving portion 86 of the stabilizer tank 82 and is collected in the stabilizer tank 82.

A recovery tray 88 is provided under the pair of squeezing rollers 74, 75. The stabilizer removed from the lithographic printing plate M by the pair of squeezing rollers 74, 75 drops through a recovery hole 93 of a stabilizer receiving member 92 provided under the pair of squeezing rollers 74, 75 into the recovery tray 88. The dropped stabilizer which is not reusable is discharged through a recovery pipe 89 at the lower end of the recovery tray 88 to the drain tank 64.

The structure of the above described stabilizer coating mechanism 73 and the coating of the lithographic printing plate M with the stabilizer will be described later in detail.

B-4. Drying Portion 34

The drying portion 34 (FIG. 2) includes a rubber roller 102 for supporting and feeding the lithographic printing plate M fed from the stabilization portion 33; a mirror surface roller 103 for abutting against the rubber roller 102 at a predetermined pressure to prevent the drying unevenness of the lithographic printing plate M; and a cleaning solution reservoir 104 for supplying a cleaning solution to the mirror surface roller 103 through the rubber roller 102. A drying mechanism 107 comprises a fan 107F and a heater 107H and for drying the lithographic printing plate M by exposure to hot air. A plurality of feed rollers 108, 109, 110 are provided for feeding the lithographic printing plate M. As depicted in FIG. 3, the cleaning solution reservoir 104 is connected through a pump 106 to a cleaning solution supply pipe 105 for supplying the cleaning solution to the pair of squeezing rollers 44, 45 of the development portion 32.

B-5. Operation of Development Unit 3

The development unit 3 develops the lithographic printing plate M in a manner to be described below.

The lithographic printing plate M with a latent image recorded thereon by the exposure unit 2 in the preceding stage is fed by the pair of introduction rollers 41, 42, and coated with the activator in an amount required for development thereof by the activator coating mechanism 43. The development of the photosensitive surface of the lithographic printing plate M coated with the activator only in the amount required for development is completed while the lithographic printing plate M is fed in a spatial development portion extending from the activator coating mechanism 43 to the pair of squeezing rollers 44, 45. The activator used for the development and remaining on the lithographic printing plate M is removed by the pair of squeezing rollers 44, 45. Then, the lithographic printing plate M is coated with the stabilizer in an amount required for stabilization thereof by the stabilizer coating mechanism 73. The lithographic printing plate M coated with the stabilizer only in the amount required for stabilization is stabilized while being fed to the pair of squeezing rollers 74, 75. The stabilizer used for the stabilization and remaining on the lithographic printing plate M is removed by the pair of squeezing rollers 74, 75. The lithographic printing plate M which has been stabilized is pushed by the mirror surface roller 103 for prevention of the drying unevenness, dried by the drying mechanism 107, and then discharged onto a discharge tray 29 shown in FIG. 1.

The development unit 3 is adapted to coat the lithographic printing plate M with the activator only in the amount required for development, thereby permitting the use of a decreased amount of activator required for processing. Further, the substantially unused activator is supplied to the lithographic printing plate M to perform constantly uniform processing on the lithographic printing plate M.

C. Details of Activator Coating Mechanism 43

C-1. Structure of Activator Coating Mechanism 43

With reference to FIG. 4, the activator coating mechanism 43 includes the activator supply pipe 122 having the plurality of discharge holes 121 bored at its lower position. The activator receiving portion 124 has the plurality of openings or through holes 123 bored at its lower end for allowing the activator to flow downwardly therethrough. The diffusion film 126 is in contact with the coating roller 125. The activator flowing down from the openings 123 of the activator receiving portion 124 is guided by the diffusion film 126 to the coating roller 125 rotating in contact with the lithographic printing plate M. The anti-backflow film 127 and the backup roller 128 are in contact with the coating roller 125. The arrow of FIG. 4 indicates the feed direction of the lithographic printing plate M.

Figure 5:
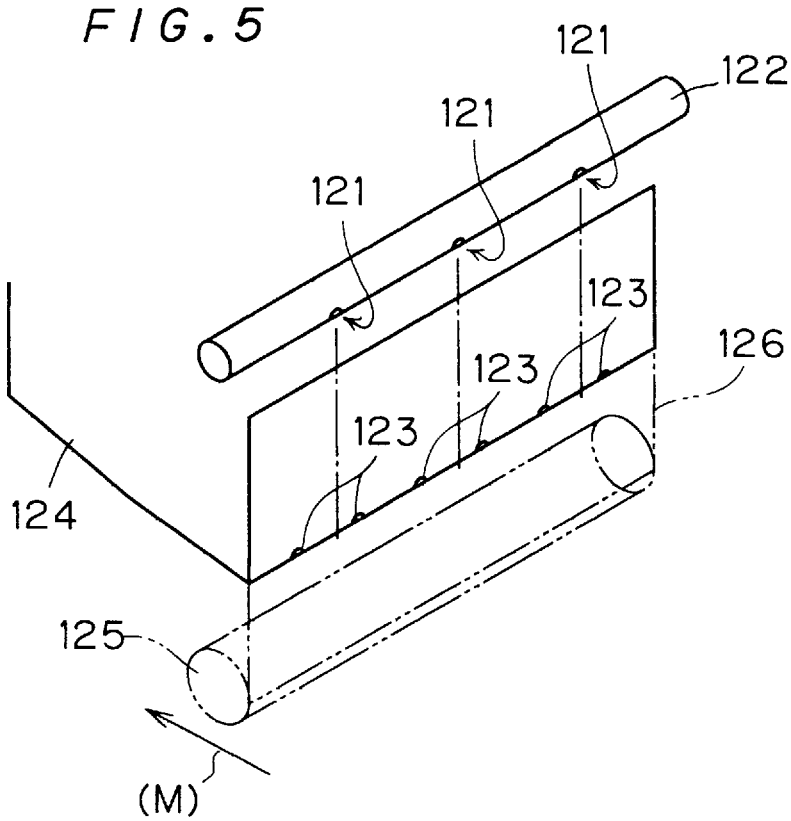
FIG. 5 is a perspective view showing the relation between discharge holes and openings.

The activator supply pipe 122 is connected to the above described activator tank 52 through the pump 53, and is driven by the pump 53 to discharge the activator from the plurality of discharge holes 121. With reference to FIG. 5, three discharge holes 121 are arranged in the direction orthogonal to the feed direction of the lithographic printing plate M.

The activator receiving portion 124 functions as a first processing liquid diffusion portion for once receiving the activator discharged from the activator supply pipe 122 to diffuse the activator in the direction orthogonal to the feed direction of the lithographic printing plate M. As illustrated in FIG. 5, six openings 123 are bored at the lower end of the activator receiving portion 124 and arranged in the direction orthogonal to the feed direction of the lithographic printing plate M. The openings 123 are positioned such that two of the openings 123 are arranged on opposite sides of a position corresponding to the position of each of the three discharge holes 121 of the activator supply pipe 122 in the direction orthogonal to the feed direction of the lithographic printing plate M. That is, the openings 123 are located on respective opposite sides of three positions at which the activator flows down from the discharge holes 121 to the activator receiving portion 124. In other words, the intervals between the plurality of discharge holes 121 are larger than the intervals between the plurality of openings 123.

The diffusion film 126 is made of polyethylene terephthalate (PET) with a thickness of about 0.3 mm and is attached to a side wall of the activator receiving portion 124 by a mounting plate 130 (see FIG. 4). A part of the diffusion film 126 which is suspended from the activator receiving portion 124 has an upper end positioned adjacent the openings 123 of the activator receiving portion 124 and a lower end in elastic contact with the surface of the coating roller 125.

Figure 6:
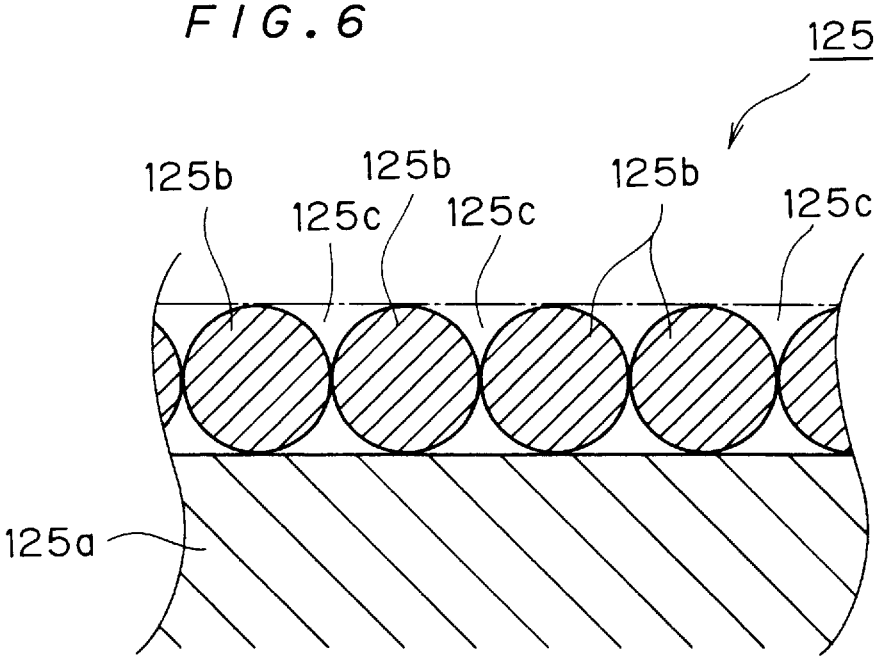
FIG. 6 is a partially enlarged cross-sectional view of a coating roller.

Referring to FIG. 6, the coating roller 125 comprises a wire bar including a metal roller 125*a* having a diameter of about 14 mm and a wire 125*b* having a diameter of about 0.4 mm and wound around the surface of the roller 125*a*. The surface of the coating roller 125 has a plurality of grooves defined by the adjacent parts of the wire 125*b* and extending substantially in parallel to the feed direction of the lithographic printing plate M. Then, with the coating roller 125 in contact with the diffusion film 126, a plurality of openings 125*c* defined by the grooves of the coating roller 125 are formed in the contact region between the coating roller 125 and the diffusion film 126. In other words, the coating roller 125 has a circumferential surface around which the plurality of openings or grooves 125*c* are formed and arranged. The amount of activator coating the lithographic printing plate M when metered is based on the dimension of the openings 125*c*. It should be noted that the dimension of the openings 123 of the activator receiving portion 124 and the diameter of the wire 125*b* wound around the coating roller 125 are selected so that the total area of the openings 125*c* defined by the grooves of the coating roller 125 is less than the total area of the six openings 123 of the activator receiving portion 124.

The activator flowing downwardly through the openings 123 of the activator receiving portion 124 is stored once in the contact region between the coating roller 125 and the diffusion film 126 and is then diffused in the direction orthogonal to the feed direction of the lithographic printing plate M. Then, as the coating roller 125 rotates, the activator passes through openings 125*c* defined by the grooves of the coating roller 125 toward the contact region between the coating roller 125 and the backup roller 128. Thus, the coating roller 125 and the diffusion film 126 function as a second processing liquid diffusion portion for once receiving the activator flowing down from the openings 123 of the activator receiving portion 124 to diffuse the activator in the direction orthogonal to the feed direction of the lithographic printing plate M.

The coating roller 125 need not necessarily be rotated, but is preferably rotated in order to provide a cleaning effect to the coating roller 125 by the contact with the backup roller 128. The coating roller 125 may comprise a roller having a threaded or grooved surface in place of the wire bar.

Similar to the diffusion film 126, the anti-backflow film 127 is made of polyethylene terephthalate (PET) and is attached to the activator receiving portion 124 by a mounting plate 120. The lower end of the anti-backflow film 127 is in contact with the surface of the coating roller 125 in a position upstream of the contact region between the coating roller 125 and the diffusion film 126 as viewed in the direction of rotation of the coating roller 125, i.e., downstream of the contact region between the coating roller 125 and the diffusion film 126 as viewed in the feed direction of the lithographic printing plate M. The anti-backflow film 127 functions as restriction means for preventing the activator flowing down from the openings 123 of the activator receiving portion 124 from flowing upstream side against the rotation of the coating roller 125. Therefore, the anti-backflow film 127 may prevent the backflow of the activator from being deposited again on the surface of the lithographic printing plate M fed while being coated with the activator.

The backup roller 128 functions as feed assist means for providing a driving force to the lithographic printing plate M in order to assist in feeding the lithographic printing plate M, as urging means for urging the lithographic printing plate M toward the surface of the coating roller 125, and as cleaning means for cleaning the surface of the coating roller 125. The backup roller 128 have an elasticity moderate enough to clean the inside of the grooves in the surface of the coating roller 125 since it is used to clean the grooves. Preferably, the backup roller 128 is made of, for example, silicone rubber, chloroprene rubber (CR), nitrile butadiene rubber (NBR), and ethylene propylene rubber (EDPM), and is in the form of a spongy roller having a large number of separate pores and having a hardness of about 10 to 40 degrees specified by JIS (the Japanese Industrial Standards), which correspond to SHORE hardness of: 11.3 to 41.8 degrees in ISO and ASTM; and 10 to 40 degrees in DIN. The diameter of the backup roller 128 is 25 mm which is about 1.8 times the diameter (13.8 mm) of the coating roller 125.

The activator passed between the coating roller 125 and the diffusion film 126 forms a puddle in the contact region between the backup roller 128 and the coating roller 125. The activator is applied to the photosensitive surface of the lithographic printing plate M when the lithographic printing plate M fed through the backup roller 128 passes through the puddle of activator. Since the backup roller 128 presses the photosensitive surface of the lithographic printing plate M against the surface of the coating roller 125, the openings 125*c* defined by the grooves of the coating roller 125 meter a constant amount of the activator coating the photosensitive surface of the lithographic printing plate M. Thus, the photosensitive surface of the lithographic printing plate M passed through the contact region between the backup roller 128 and the coating roller 125 is constantly coated with the constant amount of activator required for development. The distance over which the lithographic printing plate M is fed per second is 20 mm which is about 1.45 times the diameter (13.8 mm) of the coating roller 125.

The backup roller 128 driven by a motor (not shown) rotates at a circumferential velocity equal to the velocity at which the lithographic printing plate M is fed to assist in feeding the lithographic printing plate M. The coating roller 125, on the other hand, rotates at a circumferential velocity that is about 1.5 times the circumferential velocity of the backup roller 128. Thus, the surface of the coating roller 125 is wiped off by the backup roller 128 at all times except when the lithographic printing plate M passes through the backup roller 128 and the coating roller 125. This prevents silver sludge and the like from being deposited in the grooves of the coating roller 125, as will be described in detail later.

C-2. Operation of Activator Coating Mechanism 43

In the activator coating mechanism 43, the activator discharged form the three discharge holes 121 of the activator supply pipe 122 flows downwardly to the activator receiving portion 124 and further flows downwardly from the six openings 123 of the activator receiving portion 124 toward the diffusion film 126. Then, a stream of activator flowing down from each of the three discharge holes 121 to the activator receiving portion 124 is distributed between the pair of openings 123 located on opposite sides of each discharge hole 121 in the direction orthogonal to the feed direction of the lithographic printing plate M and is thereafter diffused in the direction orthogonal to the feed direction of the lithographic printing plate M. The activator further flows downwardly to the contact region between the diffusion film 126 and the coating roller 125 to pass through the openings 125*c* defined by the grooves of the coating roller 125. The activator is then further diffused in the direction orthogonal to the feed direction of the lithographic printing plate M.

Thus, the activator coating mechanism 43 performs two-stage activator diffusion using the activator receiving portion 124 serving as the first processing liquid diffusion portion and the coating roller 125 and diffusion film 126 serving as the second processing liquid diffusion portion, achieving the diffusion of the activator uniformly in the direction orthogonal to the feed direction of the lithographic printing plate M. This allows highly uniform supply of the activator to the lithographic printing plate M, and eliminates the development unevenness of the lithographic printing plate M during development if a small amount of activator is supplied. Another processing liquid diffusion portion may be provided between the first and second processing liquid diffusion portions.

In this preferred embodiment, in particular, since the total area of the openings 125*c* defined by the grooves of the coating roller 125 is less than that of the six openings 123 bored in the activator receiving portion 124, the activator diffusion capability of the coating roller 125 and diffusion film 126 serving as the second processing liquid diffusion portion is greater than that of the activator receiving portion 124 serving as the first processing liquid diffusion portion. The activator, accordingly, is uniformly diffused by the coating roller 125 and diffusion film 126 serving as the second processing liquid diffusion portion which finally influences the amount of activator coating the lithographic printing plate M. Finally, the activator coating mechanism 43 may diffuse the activator in highly uniform manner.

This preferred embodiment, therefore, is particularly effective when the activator is applied in order to develop the lithographic printing plate M using the silver complex salt diffusion transfer reverse method (DTR method) wherein non-uniform activator coating is prone to cause the development unevenness.

The term "diffusion capability" used herein means a capability to spread the activator in the direction orthogonal to the feed direction of the lithographic printing plate M.

C-3. Pump 53 and Activator Supply Pipe 122

Figure 7:
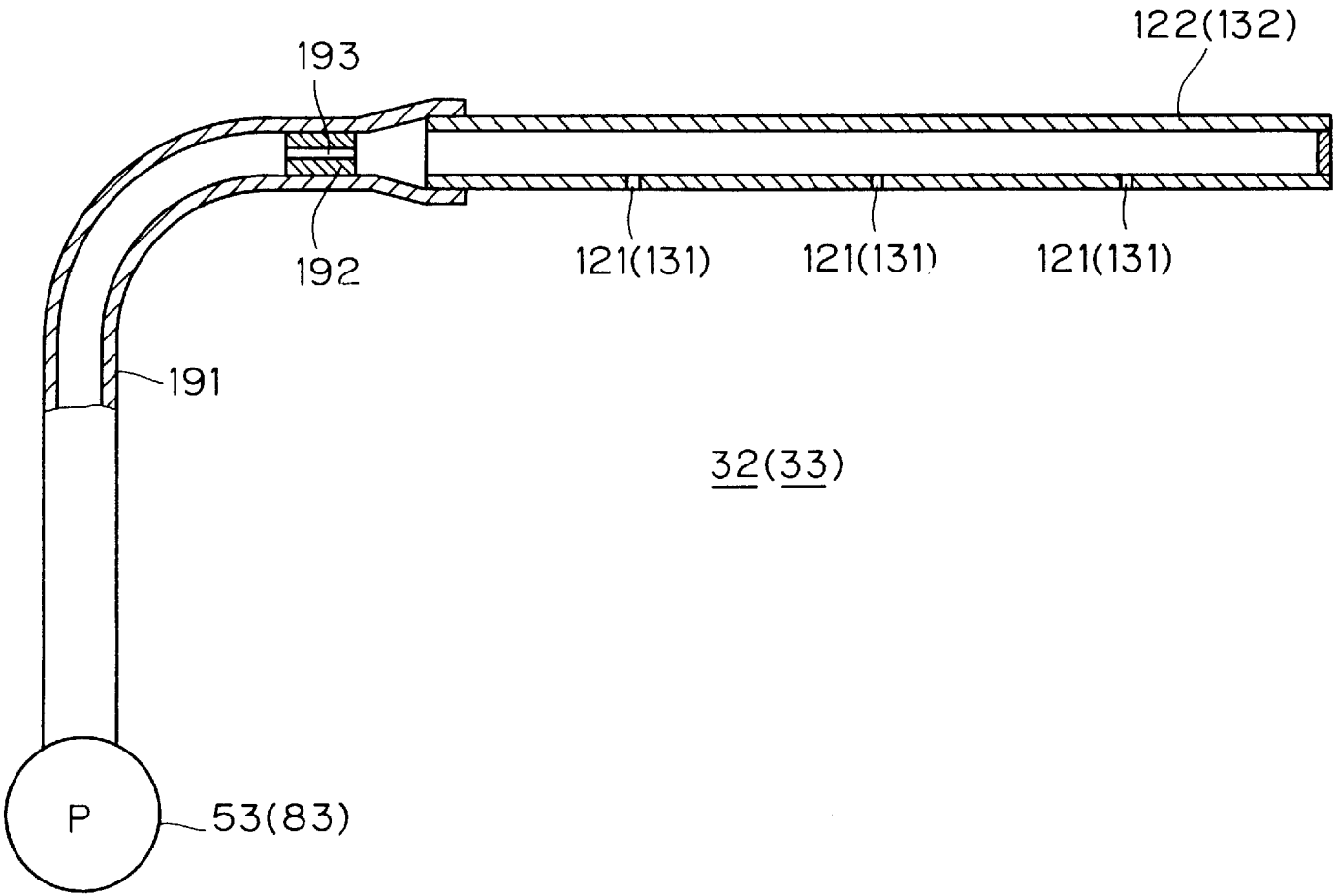
FIG. 7 is a cross-sectional view showing the connection between a pump and an activator supply pipe.

FIG. 7 is a cross-sectional view showing the connection between the pump 53 and the activator supply pipe 122 in the development portion 32.

The pump 53 used herein is a pulsation pump for generating periodical pulsation as above mentioned. When the pump 53 were simply connected to the activator supply pipe 122 having one closed end to deliver the activator under pressure, air should be sometimes drawn into the activator supply pipe 122 through, for example, an upstream one of the discharge holes 121 (the leftmost discharge hole 121 of FIG. 7) and the air bubble blocks the downstream discharge holes 121.

To prevent such a phenomenon, the apparatus according to the preferred embodiment of the present invention is adapted to establish connection between the pump 53 and the activator supply pipe 122 with an elastic tube 191 and to provide a resistance portion 192 adjacent the rear end of the tube 191 for causing a pressure loss of the activator.

More specifically, the tube 191 is made of flexible silicone rubber, and the resistance portion 192 is made of vinyl chloride. The outer diameter of the resistance portion 192 is slightly greater than the inner diameter of the tube 191 so that the resistance portion 192 inserted in the tube 191 is fixed therein. The resistance portion 192 has an activator passage bore or through hole 193 having a diameter of 1 mm. The tube 191 and the activator supply pipe 122 have an inner diameter of 4 mm. The diameter of the discharge holes 121 is 1 mm. Thus, the activator directed from the tube 191 through the activator supply pipe 122 to the discharge holes 121 encounters a high resistance and is subjected to a great pressure loss by the resistance portion 192.

As the pump 53 delivers the activator from the activator tank 52 under pressure, the pulsation of the pump 53 repeatedly gives rise to a discharging state wherein the activator is discharged from the pump 53 and a non-discharging state wherein the activator is not discharged from the pump 53. However, since the elastic tube 191 of flexible silicone rubber and the resistance portion 192 downstream of the tube 191 are provided, the tube 191 is inflated between the pump 53 and the resistance portion 192 by the pressure of the activator in the discharging state, and the inflated tube 191 is deflated as the pressure of the activator decreases in the non-discharging state. The tube 191 absorbs the pulsating flow of the activator produced by the pump 53, and there is little pulsating flow of activator passed through the activator passage bore 193 of the resistance portion 192.

Then, the activator is discharged constantly at a given pressure from the discharge holes 121 of the activator supply pipe 122, and air is not drawn into the activator supply pipe 122. This effectively prevents the non-uniform amount of activator discharged from the activator supply pipe 122 due to blocking of one or some of the discharge holes 121.

The tube 191 may be of any material which has a moderate elasticity (contraction property) and a chemical resistance. The tube 191 is not required to have an elasticity over its entire region extending between the pump 53 and the resistance portion 192 but may have an elastic portion formed at least partially between the pump 53 and the resistance portion 192 for absorbing the pulsation generated by the pump 53.

As indicated by reference numerals with parentheses in FIG. 7, the stabilization portion 33 also has an elastic tube 191 for connecting the pump 83 and a stabilizer supply pipe 132, and a resistance portion 192 adjacent the rear end of the tube 191 for causing a pressure loss of the stabilizer. Then, the stabilization portion 33, similar to the development portion 32, is adapted such that the stabilizer is discharged constantly at a given pressure from discharge holes 131 of the stabilizer supply pipe 132 and air is not drawn into the stabilizer supply pipe 132. This effectively prevents the non-uniform amount of stabilizer discharged from the stabilizer supply pipe 132 due to blocking of one or some of the discharge holes 131.

C-4. Removal of Silver Sludge and the like

In the activator coating mechanism 43, as the lithographic printing plate M is developed, silver sludge and the like containing silver and silver complex is produced from the lithographic printing plate M and deposited in the grooves defined by the wire 125*b* (FIG. 6) on the surface of the coating roller 125. To solve the problem associated with the silver sludge, the activator coating mechanism 43 is adapted such that the coating roller 125 (FIG. 4) and the backup roller 128 rotate in different circumferential velocities so that the silver sludge and the like deposited on the coating roller 125 is removed by the backup roller 128.

Figure 8:
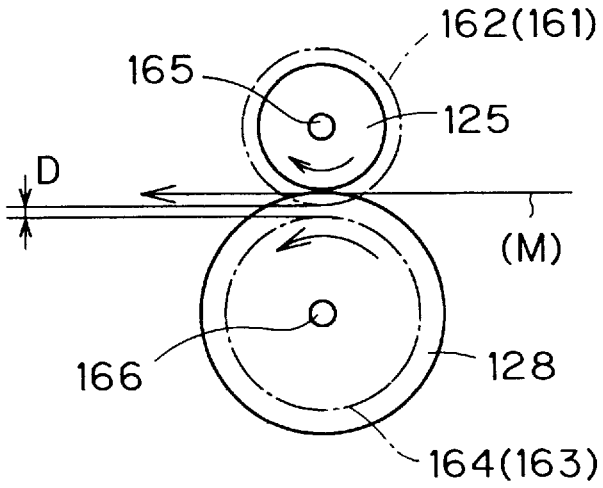
FIG. 8 is a schematic view of a drive transfer mechanism.
Figure 9:
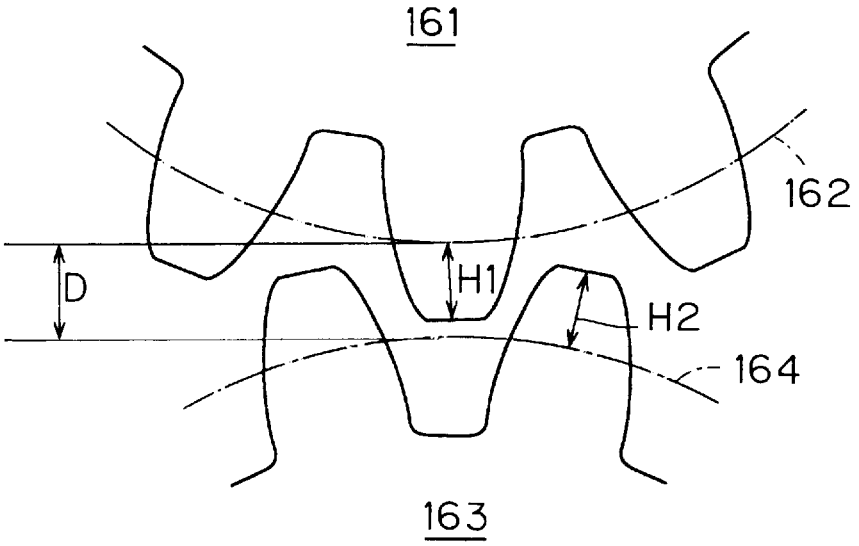
FIG. 9 is a partially enlarged schematic view of the drive transfer mechanism.

FIG. 8 is a schematic view of a drive transfer mechanism for rotating the coating roller 125 and the backup roller 128 at different circumferential velocities. FIG. 9 is a partially enlarged view of FIG. 8.

In FIGS. 8 and 9, a spur gear 161 is coupled to a driving shaft 165 of the coating roller 125, and the spur gear 161 has a pitch circle 162. A spur gear 163 is coupled to a driving shaft 166 of the backup roller 128, and the spur gear 163 has a pitch circuit 164. In FIG. 8, the spur gears 161, 163 are represented only by the pitch circles 162, 164 thereof, respectively.

The driving shaft 166 of the backup roller 128 is supported by the apparatus body. The driving shaft 165 of the coating roller 125 is supported relative to the apparatus body such that the coating roller 125 can be verticaly moved. Thus, the coating roller 125 is in contact with the backup roller 128 by gravity while being vertically movable relative to the backup roller 128.

The spur gear 163 fixed on an end of the backup roller 128 is coupled to a driving source (not shown), and the backup roller 128 rotates counterclockwise at a circumferential velocity equal to a velocity (feed velocity) at which the lithographic printing plate M is fed in the activator coating mechanism 43. On the other hand, the spur gear 161 fixed on an end of the coating roller 125 is in meshing engagement with the spur gear 163 fixed on the end of the backup roller 128. The gear ratio between the spur gears 161 and 163, that is, the velocity ratio therebetween is different from the diameter ratio between the coating roller 125 and the backup roller 128. The coating roller 125 thus rotates clockwise at the circumferential velocity different from the circumferential velocity of the backup roller 128.

In this manner, the coating roller 125 and the backup roller 128 rotate at the different circumferential velocities. Thus, the surface of the coating roller 125 is wiped off by the backup roller 128 at all times except when the lithographic printing plate M passes through the backup roller 128 and the coating roller 125. This prevents silver sludge and the like from being deposited in the grooves of the coating roller 125.

The surface of the backup roller 128, as above described, is flexible and spongy because of the need to have the elasticity moderate enough to clean the inside of the grooves in the surface of the coating roller 125. This causes the gradual decrease in the diameter of the backup roller 128 due to wear of the backup roller 128 after a certain amount of continuous rotation of the backup roller 128 at the circumferential velocity different from that of the metal coating roller 125 in contact with the surface of the metal coating roller 125. The excessively decreased diameter of the backup roller 128 may create a clearance between the coating roller 125 and the backup roller 128 since the driving shafts 165 and 166 do not come within a fixed distance or shorter due to the meshing engagement between the spur gears 161 and 163 even when the coating roller 125 is in contact with the backup roller 128 by gravity. Then, the backup roller 128 need replacement.

To overcome this problem, in the activator coating mechanism 43, the contours of the coating roller 125 and backup roller 128 are determined so that the pitch circle 162 of the spur gear 161 and the pitch circle 164 of the spur gear 163 are spaced a distance D less than the sum of the addendums H1, H2 of the spur gears 161, 163, or H1+H2, apart from each other, with the coating roller 125 in contact with the backup roller 128 by gravity, as illustrated in FIG. 9. Then, the spur gears 161 and 163 are in normal conditions wherein the pitch circles 162 and 164 thereof are tangent externally when the radius of the backup roller 128 is decreased by the distance D due to wear. The backup roller 128 may be used until the decreased radius of the backup roller 128 is further decreased by a given dimension. This allows a long-term use of the backup roller 128 which is flexible and prone to wear.

In the arrangement of FIG. 8, the pitch circle 162 of the spur gear 161 coupled to the driving shaft 165 of the coating roller 125 is spaced the distance D apart from the pitch circle 164 of the spur gear 163 coupled to the driving shaft 166 of the backup roller 128. Instead, as illustrated in FIG. 10, the spur gear 161 coupled to the driving shaft 165 of the coating roller 125 and the spur gear 163 coupled to the driving shaft 166 of the backup roller 128 may be coupled together through a third spur gear 171 having a pitch circle 172 and a fourth spur gear 173 having a pitch circle 174, with the third spur gear 171 located laterally relative to the spur gear 161.

Figure 10:
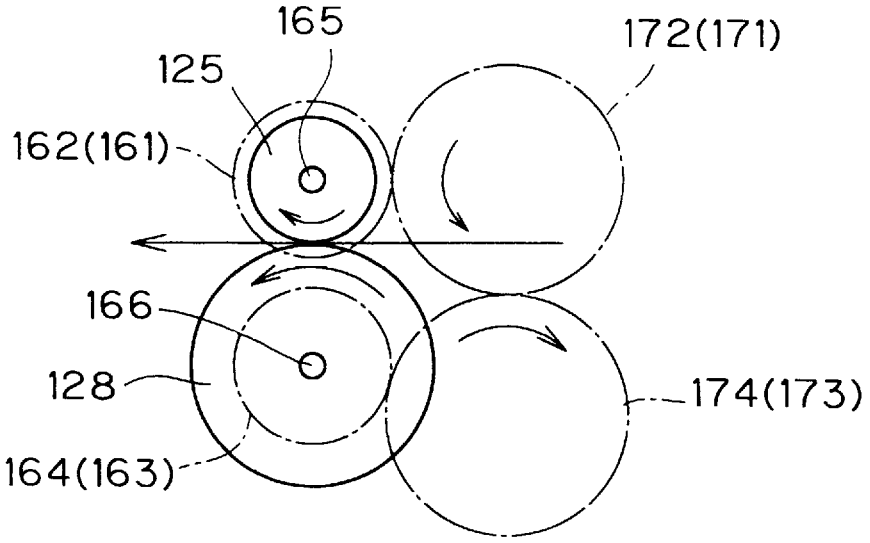
FIG. 10 is a schematic view of the drive transfer mechanism.

In the arrangement of FIG. 10, if the radius of the backup roller 128 decreases due to wear, the coating roller 125 moves downwardly with the decrease in the radius of the backup roller 128 and held in contact with the backup roller 128 at all times since the spur gears 161 and 163 are not in direct meshing engagement. The coupling between the spur gear 161 and the spur gear 171 is not broken by the downward movement of the coating roller 125 since the third spur gear 171 is located laterally relative to the spur gear 161 coupled to the driving shaft 165 of the coating roller 125.

C-5. Diameter of Coating Roller 125

In the activator coating mechanism 43, it is preferable that consideration to be described below is given to prevent development failures in a leading edge portion of the lithographic printing plate M to be developed first and in other than leading edge portions of the lithographic printing plate M to be successively developed when the coating roller 125 applies a small mount of activator to the photosensitive surface of the lithographic printing plates M.

Figure 11:
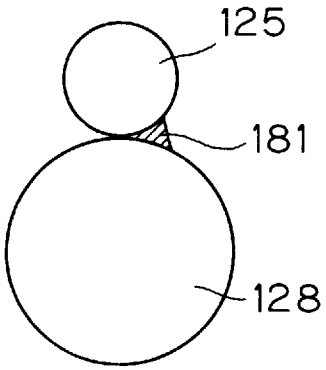
FIG. 11 illustrates a puddle of processing liquid.

Specifically, when a puddle 181 (FIG. 11) of activator having a given volume is not previously formed between the coating roller 125 and the backup roller 128, the development failure, in particular, a plate life failure of the lithographic printing plates M using the silver complex salt diffusion transfer reverse method (DTR method) occurs in the leading edge portion of the lithographic printing plate M to be developed first.

Studies conducted by the inventors of the present invention have revealed that the puddle 181 to be previously formed between the coating roller 125 and the backup roller 128 may be of desired volume by setting the diameter of the backup roller 128 greater by a constant amount than that of the coating roller 125. That is, the setting of the diameter of the backup roller 128 greater than that of the coating roller 125 enables the puddle 181 to be held in a stable manner between the backup roller 128 and the coating roller 125, permitting the increase in volume of the puddle 181 to be previously formed.

More specifically, the diameter of the backup roller 128 is not less than 1.25 times, more preferably not less than 1.5 times, that of the coating roller 125. This allows the puddle 181 between both of the rollers 125 and 128 to have a volume suitable for development of the leading edge portion of the lithographic printing plate M. If the diameter of the backup roller 128 is less than 1.25 times that of the coating roller 125, the deficiency of the volume of the puddle 181 causes the plate life failure in the leading edge portion of the lithographic printing plate M. The diameter of the coating roller 125 termed herein means the outer diameter of the coating roller 125 including the wire 125*b* wound around the surface of the roller 125*a* shown in FIG. 6.

Figure 12:
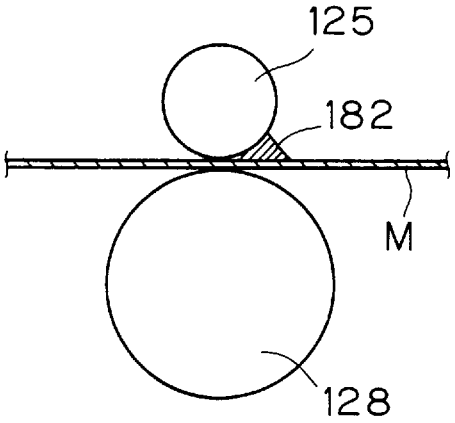
FIG. 12 illustrates another puddle of processing liquid.

On the other hand, when a puddle 182 of activator having a given volume as shown in FIG. 12 is not maintained between the lithographic printing plate M and the coating roller 125, the development failure, in particular, the plate life failure of the lithographic printing plate M using the silver complex salt diffusion transfer reverse method (DTR method) occurs in other than leading edge portions of the lithographic printing plate M to be successively developed.

Studies conducted by the inventors of the present invention have revealed that the volume of the puddle 182 formed between the lithographic printing plate M and the coating roller 125 depends on the diameter of the coating roller 125 and that proper development may be performed using a small amount of activator by setting the diameter of the coating roller 125 and the feed velocity of the lithographic printing plate M to respective predetermined values.

Specifically, when the diameter of the coating roller 125 ranges from about 5 to about 70 mm, the volume of the puddle 182 of activator formed between the coating roller 125 and the lithographic printing plate M while the coating roller 125 applies the activator to the lithographic printing plate M increases in direct proportion to the diameter of the coating roller 125.

The feed velocity of the lithographic printing plate M may be increased when the volume of the puddle 182 is relatively large. When the volume of the puddle 182 is relatively small, the feed velocity of the lithographic printing plate M must be decreased, which would otherwise decrease the printing performance of the developed lithographic printing plate M and, particularly, the plate life. Therefore, the diameter of the coating roller 125 is preferably greater relative to the feed velocity of the lithographic printing plate M in terms of developability. On the other hand, if the puddle 182 has a large volume but the feed velocity of the lithographic printing plate M is low, the prolonged time over which the lithographic printing plate M contacts the activator of the puddle 182 fatigues an excess amount of activator which is supplied by metering of the coating roller 125 but is not applied to the lithographic printing plate M . Then, the reuse of the excess amount of activator is not permitted. Therefore, the diameter of the coating roller 125 is preferably smaller relative to the feed velocity of the lithographic printing plate M in terms of effective use of the activator.

Further studies in consideration for the above described results have revealed that the feed distance of the lithographic printing plate M per second as the feed velocity of the lithographic printing plate M should be in the range of from 1.1 times to 2.5 times the diameter of the coating roller 125 to achieve stable and proper processing with a small amount activator without fatigue of the excess amount of activator.

Based on these conditions, the activator coating mechanism 43 is designed such that the diameter of the backup roller 128 is 25 mm which is not less than 1.25 times the diameter (13.8 mm) of the coating roller 125 and such that the feed distance of the lithographic printing plate M per second is 20 mm which is in the range of from 1.1 times to 2.5 times the diameter (13.8 mm) of the coating roller 125.

In consideration of the two conditions, the diameter of the coating roller 125 is preferably about 5 to 30 mm and more preferably about 8 to 25 mm. The coating roller 125 having a smaller diameter fails to form the puddles 181 and 182 of a desired volume in cooperation with the backup roller 128 and the lithographic printing plate M. The coating roller 125 having a greater diameter is liable to deteriorate the coating uniformity, resulting in increased size of the apparatus. In particular, the lithographic printing plate M to be processed by the silver complex salt diffusion transfer reverse method (DTR method) may be accurately coated with the activator when the diameter of the coating roller 125 is not more than 30 mm, more preferably not more than 25 mm. The diameter of the backup roller 128 depending upon the diameter of the coating roller 125 is preferably not less than 7 mm for similar reasons, and more particularly in the range from about 10 to 50 mm. The feed velocity of the lithographic printing plate M which is dependent upon the diameter of the coating roller 125 and the size of the entire development unit 3 is preferably 10 to 60 mm/sec., more preferably 15 to 40 mm/sec.

The amount of activator supplied to the coating roller 125 influences the formation of the puddles 181 and 182 and, hence, must be appropriate. The amount of activator supplied to the coating roller 125 is preferably 115 to 400% (i.e., a 15 to 300% excess) based on the amount of activator carried by the lithographic printing plate M which has been passed through the coating roller 125 (the amount of activator coating the lithographic printing plate M), and more preferably 130 to 200% (i.e., a 30 to 100% excess). The amount of activator coating the lithographic printing plate M is preferably 10 to 80 $ml/m^2$, more preferably 20 to 60 $ml/m^2$.

The activator is uniformly supplied along the width of the lithographic printing plate M (in the direction orthogonal to the feed direction thereof). The supply of the activator is in a range slightly wider than the width of the lithographic printing plate M. Further, the development unit 3 having a fixed width processes the lithographic printing plates M of various sizes in some cases. In these cases, the width of supply of the activator is in general unchanged. Thus, the ratio between the amount of carried activator and the amount of supplied activator is that per unit length of the lithographic printing plate M. That is, the above described amount of supplied activator is provided by conversion as the amount of supplied activator per length equal to the width of the lithographic printing plate M.

From another viewpoint, the amount of activator supplied to the coating roller 125 is preferably 15 to 200 ml/min., and more preferably 30 to 100 ml/min. per length of 1000 mm in the direction orthogonal to the feed direction of the lithographic printing plate M.

C-6. Activator Coating Mechanism 43 in Another Preferred Embodiment

Figure 13:
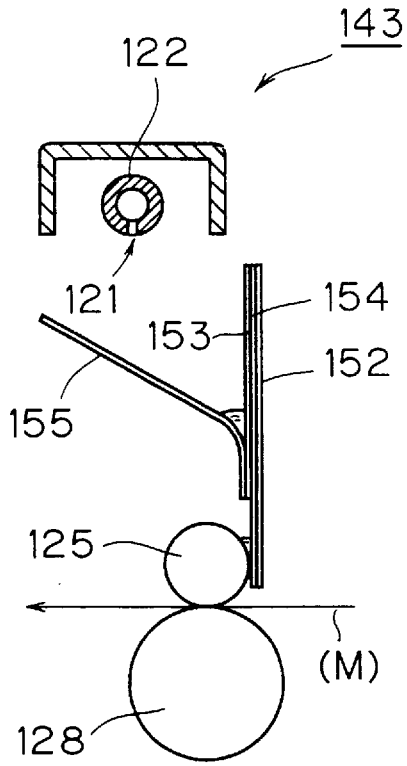
FIG. 13 is a schematic view of an activator coating mechanism according to another preferred embodiment of the present invention.

The activator coating mechanism 43 of the apparatus according to another preferred embodiment of the present invention will be discussed below. FIG. 13 is a schematic view of an activator coating mechanism 143 according to this preferred embodiment of the present invention. Like reference numerals and characters are used to designate members identical with those of the activator coating mechanism 43 shown in FIG. 4, and detailed description of the identical members are dispensed with.

In the activator coating mechanism 43 shown in FIG. 4, the activator receiving portion 124 and the diffusion film 126 are used to form the first and second processing liquid diffusion portions. In the activator coating mechanism 143 shown in FIG. 13, a plurality of embossed films 153 and 154 having uneven or rough surfaces are used to form the first and second processing liquid diffusion portions.

Figure 14:
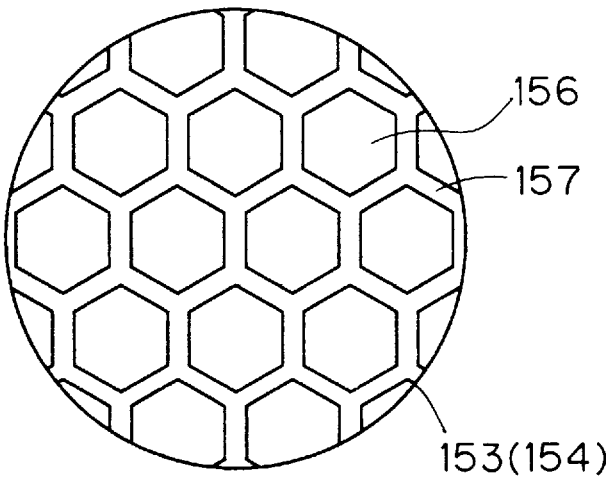
FIG. 14 illustrates hexagonal protrusions and recesses.

With reference to FIG. 13, the embossed film 154 having uneven or rough surface is stacked on a stainless sheet 152 having a thickness of about 0.03 mm, and the embossed film 153 is stacked on the embossed film 154. The surface of the embossed film 154 is in elastic contact with the surface of the coating roller 125 including the wire bar because of the elasticity of the stainless sheet 152. An activator receiving film 155 made of, for example, polyethylene terephthalate (PET) is located in a contact position with the surface of the embossed film 153. The embossed films 153 and 154 are formed, for example, by pressing resin films to emboss the surface thereof into uneven configuration. Referring to FIG. 14, the surface of the embossed films 153 and 154 has hexagonal protrusions 156 and a recess 157 surrounding each protrusion 156. In other words, surfaces with two dimensional distribution of ups and downs are provided on the embossed films 153 and 154. In particular, the surface structure of ups and downs in the direction along the axis of the coating roller 125 is effective to spread the activator in the whole width of the lithographic printing plate M.

In the activator coating mechanism 143, the activator discharged from the three discharge holes 121 of the activator supply pipe 122 flows downwardly through first openings defined by the recesses 157 of the embossed film 153 between the activator receiving film 155 and the embossed film 153. Then, the activator is diffused in the direction orthogonal to the feed direction of the lithographic printing plate M. The activator further flows downwardly to a contact region between the coating roller 125 and the embossed film 154 and passes through second openings defined by the recesses 157 of the embossed film 154 and the openings 125*c* of the coating roller 125 shown in FIG. 6. Then, the activator is further diffused in the direction orthogonal to the feed direction of the lithographic printing plate M.

The dimension of the recesses 157 of the embossed film 153 is greater than that of the recesses 157 of the embossed film 154 in order that the area of the first openings per unit length is greater than the area of the second openings per unit area in the direction orthogonal to the feed direction of the lithographic printing plate M. The relationship between these areas is described below.

The dimension of the recesses 157 of the embossed film 154 is set so that the cross-sectional area SB of the recesses 157 of the embossed film 154 per unit length is about 0.1 to 0.8 times the cross sectional area SO of the openings 125*c* defined by the wire 125*b* of the coating roller 125 shown in FIG. 6 per unit length in the direction orthogonal to the feed direction of the lithographic printing plate M to prevent excessive growth of a puddle of activator in the contact region between the coating roller 125 and the backup roller 128. The dimension of the recesses 157 of the embossed film 153 is set so that the cross sectional area SA of the first openings defined by the recesses 157 of the embossed film 153 per unit length is about 1 to 2 times the combined cross-sectional area (SO+SB) of the second openings per unit length. Since the coating roller 125 and the embossed films 153, 154 have a common length in the direction orthogonal to the feed direction of the lithographic printing plate M through which the activator passes, the above indicated ratio between the areas SO, SA, SB per unit length (i.e., per unit width) equals to the area ratio for the whole width of the coating roller 125 and the embossed films 153, 154.

In this manner, the activator coating mechanism 143 performs two-stage activator diffusion using the activator receiving film 155 and embossed film 153 functioning as the first processing liquid diffusion portion, and the coating roller 125 and embossed film 154 functioning as the second processing liquid diffusion portion, achieving the diffusion of the activator uniformly in the direction orthogonal to the feed direction of the lithographic printing plate M. This allows highly uniform supply of the activator to the lithographic printing plate M, and eliminates the development unevenness of the lithographic printing plate M during the development if a small amount of activator is supplied.

In this preferred embodiment, the total cross-sectional area of the first openings is greater than the total cross-sectional area of the second openings. Accordingly, the activator diffusion capability of the coating roller 125 and embossed film 154 functioning as the second processing liquid diffusion portion is greater than that of the activator receiving film 155 and embossed film 153 functioning as the first processing liquid diffusion portion. Therefore, the activator may be diffused more uniformly.

Although not shown in this preferred embodiment, the activator coating mechanism 143 of FIG. 8 comprises restriction means similar to the anti-backflow film 127 shown in FIG. 4 or an anti-backflow roller 129 which will be described later with reference to FIG. 21.

D. Details of Stabilizer Coating Mechanism 73

D-1. Structure of Stabilizer Coating Mechanism 73

Figure 15:
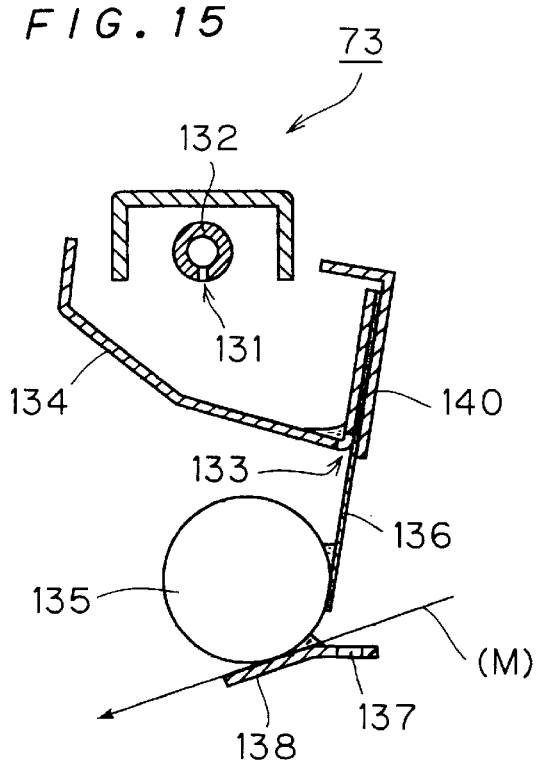
FIG. 15 is a schematic view of a stabilizer coating mechanism.

The structure of the stabilizer coating mechanism 73 is described below. FIG. 15 is a schematic view of the stabilizer coating mechanism 73.

The stabilizer coating mechanism 73 includes the stabilizer supply pipe 132 having the plurality of discharge holes 131 bored at its lower position; a stabilizer receiving portion 134 having a plurality of openings 133 bored at its lower end for allowing the stabilizer to flow downwardly therethrough; and a coating roller 135 for rotating in contact with the lithographic printing plate M. A diffusion film 136 guides to the coating roller 135 the stabilizer flowing down from the openings 133 of the stabilizer receiving portion 134. A plate spring 138 is in contact with the coating roller 135. The arrow of FIG. 15 indicates the feed direction of the lithographic printing plate M.

Figure 16:
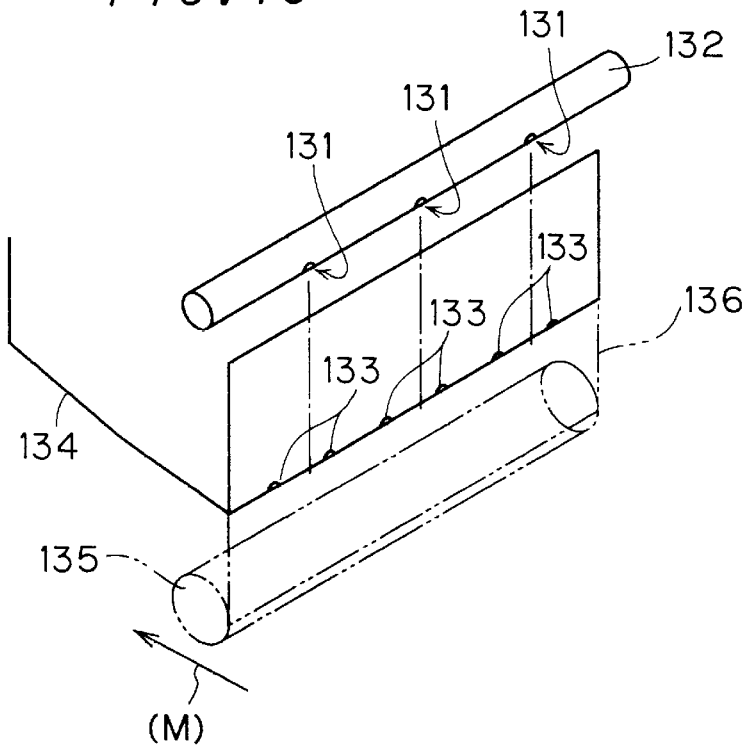
FIG. 16 is a perspective view showing the relation between discharge holes and openings.

The stabilizer supply pipe 132 is connected to the above described stabilizer tank 82 through the pump 83, and is driven by the pump 83 to discharge the stabilizer from the plurality of discharge holes 131. With reference to FIG. 16, three discharge holes 131 are arranged in the direction orthogonal to the feed direction of the lithographic printing plate M.

The stabilizer receiving portion 134 functions as a stabilizer diffusion portion for once receiving the stabilizer discharged from the stabilizer supply pipe 132 to diffuse the stabilizer in the direction orthogonal to the feed direction of the lithographic printing plate M. As illustrated in FIG. 16, six openings 133 are bored at the lower end of the stabilizer receiving portion 134 and arranged in the direction orthogonal to the feed direction of the lithographic printing plate M. The openings 133 are positioned such that two of the openings 133 are arranged on opposite sides of a position corresponding to the position of each of the three discharge holes 131 of the stabilizer supply pipe 132 in the direction orthogonal to the feed direction of the lithographic printing plate M. That is, the openings 133 are located on respective opposite sides of the three positions at which the stabilizer flows down from the discharge holes 131 to the stabilizer receiving portion 134. In other words, the intervals between the plurality of discharge holes 131 are larger than the intervals between the plurality of openings 133.

Figure 17:
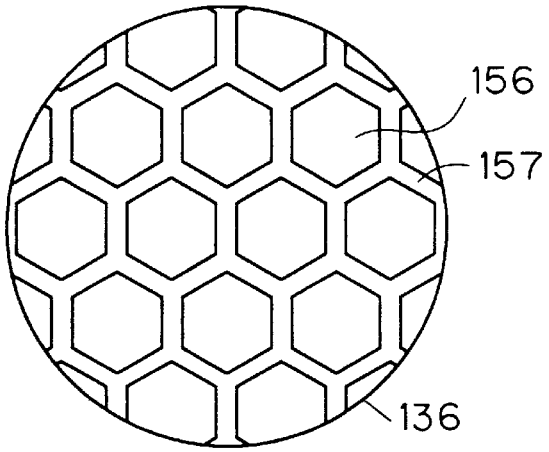
FIG. 17 is an enlarged plan view of a surface configuration of a diffusion film.

The diffusion film 136 comprises a stainless sheet having a thickness of about 0.03 mm, and an embossed film stacked on the stainless sheet and having hexagonal protrusions 156 and a recess 157 surrounding each protrusion 156 as shown in FIG. 17. The diffusion film 136 is attached to a side wall of the stabilizer receiving portion 134 by a mounting plate 140. A part of the diffusion film 136 which is suspended from the stabilizer receiving portion 136 has an upper end positioned adjacent the openings 133 of the stabilizer receiving portion 134 and a lower end in elastic contact with the surface of the coating roller 135. The character of the surface structure as already described with reference to FIG. 14 is also applicable to the surface structure shown in FIG. 17.

Figure 18:
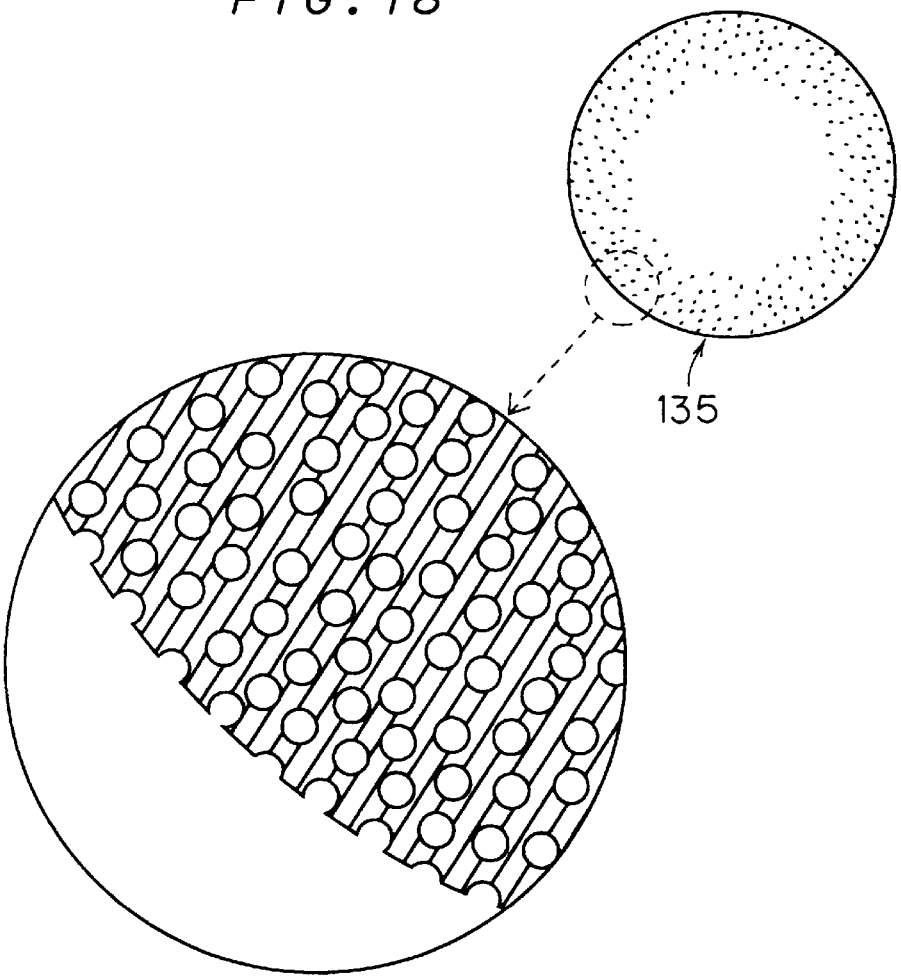
FIG. 18 is a partial cross section of a spongy roller having a large number of separate pores.

The coating roller 135 rotates at a circumferential velocity equal to the feed velocity of the lithographic printing plate M, and has a surface made of sponge containing a large number of separate pores, as illustrated in FIG. 18. With the coating roller 135 in contact with the diffusion film 136, openings defined by the recess 157 in the surface of the diffusion film 136 are formed in a contact region between the coating roller 135 and the diffusion film 136. The configuration of the protrusions and recesses of the diffusion film 136 is selected so that the total cross-sectional area of the openings defined by the recesses 157 in the suffice of the diffusion film 136 is less than the total cross-sectional area of the six openings 133 bored in the above describe stabilizer receiving portion 134.

The stabilizer flowing downwardly through the openings 133 of the stabilizer receiving portion 134 is stored once in the contact region between the coating roller 135 and the diffusion film 136 and is then diffused in the direction orthogonal to the feed direction of the lithographic printing plate M. Then, as the coating roller 135 rotates, the stabilizer passes through openings defined by the recesses in the surface of the diffusion film 136 toward a contact region between the coating roller 135 and the plate spring 138. Thus, the coating roller 135 and the diffusion film 136 function as the stabilizer diffusion portion for once receiving the stabilizer flowing down from the openings 133 of the stabilizer receiving portion 134 to diffuse the stabilizer in the direction orthogonal to the feed direction of the lithographic printing plate M.

The plate spring 138 functions as means for urging the lithographic printing plate M toward the coating roller 135 and as means for forming a puddle of stabilizer between the plate spring 138 and the coating roller 135. The stabilizer passed through the opening defined by the recesses 157 in the surface of the diffusion film 136 forms a puddle of stabilizer in the contact region between the plate spring 138 and the coating roller 135.

The plate spring 138 has an overflow hole 137 for preventing the stabilizer from being stored in an amount more than necessary in the contact region between the plate spring 138 and the coating roller 135 which might result in the puddle having an excess volume.

D-2. Operation of Stabilizer Coating Mechanism 73

In the stabilizer coating mechanism 73, the stabilizer discharged from the three discharge holes 131 (FIGS. 15 and 16) of the stabilizer supply pipe 132 flows downwardly to the stabilizer receiving portion 134 and further flows downwardly from the six openings 133 of the stabilizer receiving portion 134 toward the diffusion film 136. Then, a stream of stabilizer flowing down from each of the three discharge holes 131 to the stabilizer receiving portion 134 is distributed between the pair of openings 133 located on opposite sides of each discharge hole 131 in the direction orthogonal to the feed direction of the lithographic printing plate M and is thereafter diffused in the direction orthogonal to the feed direction of the lithographic printing plate M. The stabilizer further flows downwardly to the contact region between the diffusion film 136 and the coating roller 135 to pass through the openings defined by the recesses 157 of the diffusion film 136. The stabilizer is then further diffused in the direction orthogonal to the feed direction of the lithographic printing plate M.

The stabilizer passed through the contact region between the diffusion film 136 and the coating roller 135 forms a puddle of stabilizer in the contact region between the plate spring 138 and the coating roller 135. The stabilizer is applied to the lithographic printing plate M when the lithographic printing plate M passes through the puddle of stabilizer. Since the plate spring 138 presses the photosensitive surface of the lithographic printing plate M against the surface of the coating roller 135, the multiplicity of pores contained in the sponge of the surface of the coating roller 135 meter a constant amount of the stabilizer coating the photosensitive surface of the lithographic printing plate M. Thus, the photosensitive surface of the lithographic printing plate M passed through the contact region between the plate spring 138 and the coating roller 135 is constantly coated with the constant amount of stabilizer required for stabilization.

The lithographic printing plate M fed to the stabilizer coating mechanism 73 has been coated with the activator by the activator coating mechanism 43 in the preceding process step for development and, hence, has a photosensitive film swelled by the activator. In the stabilizer coating mechanism 73, however, the photosensitive surface of the lithographic printing plate M contacts only the coating roller 136 having the surface made of flexible sponge containing a large number of separate pores, and thus is not subjected to damages.

The surface of the coating roller 135 is, in particular, made of sponge containing a large number of separate pores which precludes the stabilizer contacting the surface thereof from entering the inside of the coating roller 135. This prevents a waste stabilizer from being mixed with a new stabilizer supplied from the stabilizer supply pipe 132 and applied to the lithographic printing plate M.

The stabilizer coating mechanism 73 of this preferred embodiment performs two-stage stabilizer diffusion using the stabilizer receiving portion 134 serving as the first stabilizer diffusion portion and the coating roller 135 and diffusion film 136 serving as the second stabilizer diffusion portion, achieving the diffusion of the stabilizer uniformly in the direction orthogonal to the feed direction of the lithographic printing plate M. This allows highly uniform supply of the stabilizer to the lithographic printing plate M. Since the total area of the opening defined by the recess 157 of the diffusion film 136 is less than that of the six openings 133 bored in the stabilizer receiving portion 134, the stabilizer diffusion capability of the coating roller 135 and diffusion film 136 is greater than that of the stabilizer receiving portion 134. The stabilizer, accordingly, is uniformly diffused by the coating roller 135 and diffusion film 136 serving as the stabilizer diffusion portion which finally influences the amount of stabilizer coating the lithographic printing plate M. Finally, the stabilizer coating mechanism 73 may diffuse the stabilizer in highly uniform manner.

E. Details of Supply Operation of Activator and Stabilizer

Figure 19:
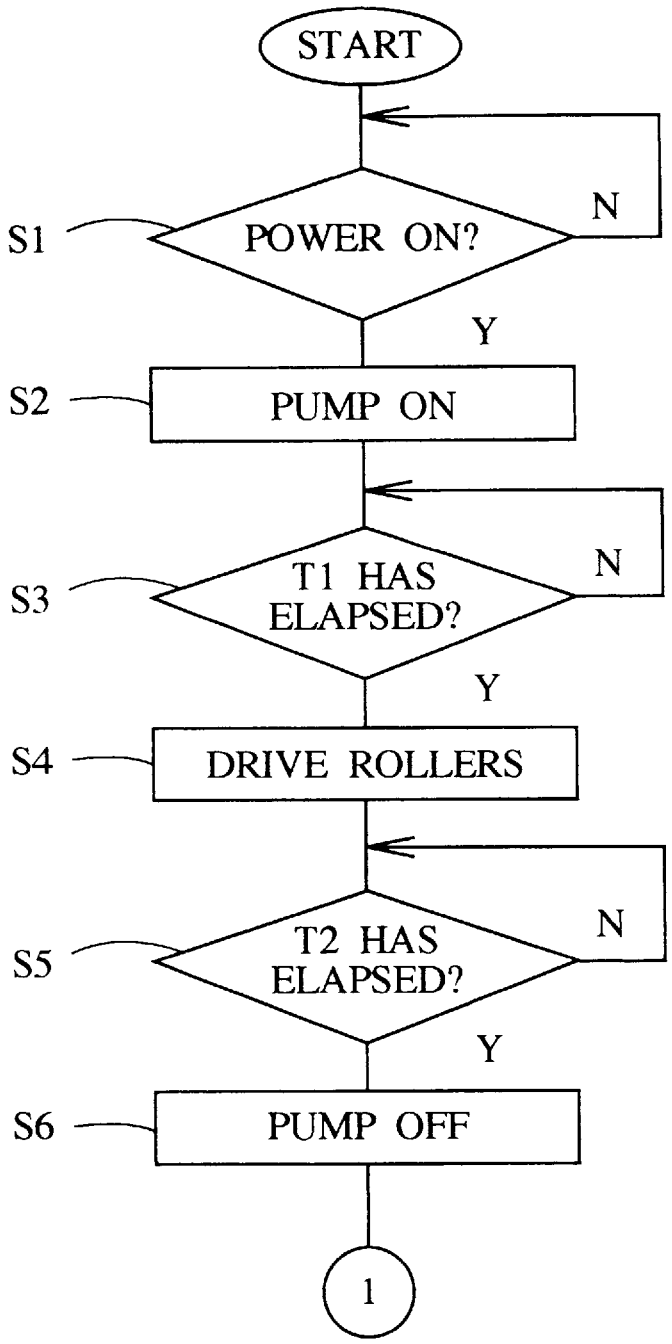
FIGS. 19 and 20 are flow charts showing the operation for supplying an activator.
Figure 20:
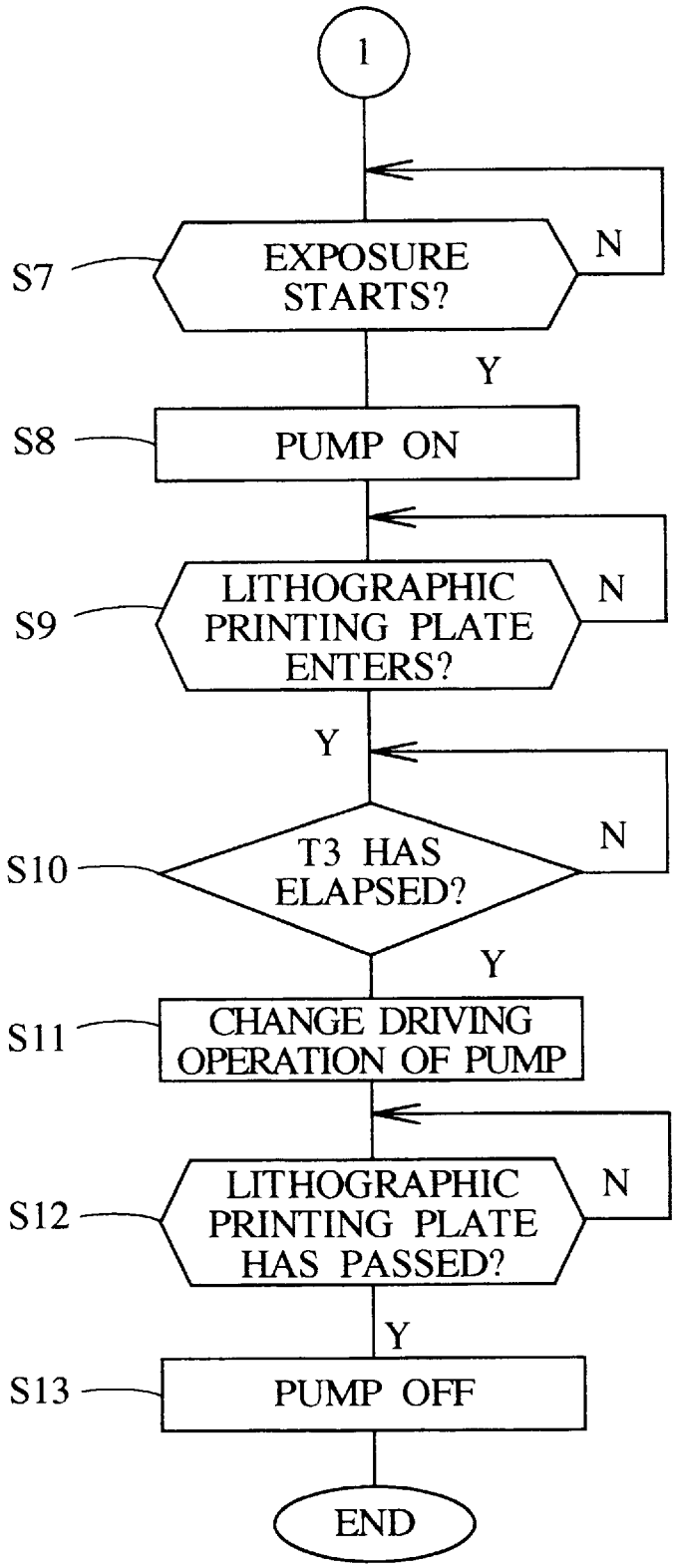

The operation for supplying the activator and stabilizer which is a feature of the present invention will be discussed below. FIGS. 19 and 20 are a flow chart showing the operation for supplying the activator.

For exposure and development of the lithographic printing plate M, electric power is supplied to the plate making apparatus comprising the exposure unit 2 and the development unit 3 (step S1). When the plate making apparatus is switched on, the pump 53 is driven to supply the activator from the activator tank 52 to the activator supply pipe 122 of the activator coating mechanism 43 (step S2). The amount of activator supplied in the step S2 is greater than the amount of activator to be supplied during the coating of the lithographic printing plate M with the activator by the activator coating mechanism 43. The term "during the coating" means "when the lithographic printing plate M passes through a nip position between the coating roller 125 and the backup roller 128".

The activator supplied from the activator tank 52 to the activator supply pipe 122 of the activator supply mechanism 43 flows sequentially along the activator receiving portion 124, the diffusion film 126, the coating roller 125, and the backup roller 128 to drop into the recovery tray 54. Then, the activator drops through the recovery pipe 55 at the lower end of the recovery tray 54 into the activator receiving portion 56 of the activator tank 52. The activator is collected in the activator tank 52 for circulation. This fuses and removes crystals of the activator deposited on the coating roller 125 and the backup roller 128. At this time, the heater 57 raises the temperature of the activator up to a predetermined temperature.

After an elapse of time T1 (step S3), the coating roller 125 and the backup roller 128 are rotated. This causes the activator to be supplied to the entire outer peripheral surfaces of the coating roller 125 and backup roller 128, completely removing the crystal of the activator. The coating roller 125 and the backup roller 128 are rotated after the time T1 has elapsed since the activator supply starts in order to prevent the crystal of the activator from damaging the coating roller 125 and backup roller 128 which rotate in contact with each other prior to fusion of a certain amount of crystal of the activator. The time T1 is set to, for example, about 30 seconds.

Then, when the temperature of the activator is raised up to the predetermined temperature and the crystal of the activator is removed after an elapse of time T2 (step S5), the pump 53 stops driving to stop the supply of the activator (step S6). The time T2 is set to, for example, about 2 minutes.

The above described initial operation may remove the crystals of the activator by circulation of the activator if the crystals of the activator is produced on the surfaces of the coating roller 125 and backup roller 128 after a long-term non-operation of the apparatus, preventing damages to the surfaces of the coating roller 125 and backup roller 128 and to the lithographic printing plate M fed in contact with the rollers 125 and 128.

When the exposure unit 2 starts exposing the lithographic printing plate M (step S7) after the above described initial operation, the pump 53 is driven again to supply a large amount of activator from the activator tank 52 to the activator supply pipe 122 of the activator coating mechanism 43 (step S8). This circulates the heated temperature-controlled activator to raise the temperature of the whole activator circulation passage including the activator supply pipe 122, the activator receiving portion 124, the diffusion film 126, the coating roller 125, the backup roller 128, the recovery tray 54, and the activator tank 52. The circulation of a large amount of processing liquid forms a puddle of activator having a volume required for development between the rotating coating roller 125 and the rotating backup roller 128.

A predetermined amount of exposure of the lithographic printing plate M is completed, and the leading edge of the lithographic printing plate M starts entering the development portion 32 through the rollers 27, 28 of the buffer portion 26 (step S9). Then, after an elapse of time T3 (step S10), the driving operation of the pump 53 is changed to reduce the amount of activator to be discharged so that the amount of activator circulating through the activator circulation passage including the activator supply pipe 122, the activator receiving portion 124, the diffusion film 126, the coating roller 125, the backup roller 128, the recovery tray 54, and the activator tank 52 is optimum for development of the lithographic printing plate M (step S11).

The time T3 is that required for the leading edge of the lithographic printing plate M starting entering the development portion 32 to reach the nip position between the coating roller 125 and the backup roller 128 of the activator coating mechanism 43, that is, the time required for the leading edge of the lithographic printing plate M starting entering the development portion 32 to reach the puddle of activator formed between the coating roller 125 and the backup roller 128 and to be coated with the activator. That is, the amount of circulating activator is changed to an optimum amount for development until the leading edge of the lithographic printing plate M reaches the puddle of activator formed between the coating roller 125 and the backup roller 128 of the activator coating mechanism 43 and is coated with the activator.

Since the activator passed through the circulation passage of the activator whose temperature has been raised is applied to the lithographic printing plate M through the coating roller 125, the activator which has coated the lithographic printing plate M has the predetermined temperature, precluding the processing unevenness resulting from the temperature of the activator. Further, the puddle of activator having a volume required for development is previously formed between the coating roller 125 and the backup roller 128 when the lithographic printing plate M is coated with the activator, precluding the processing unevenness resulting from the shortage of the activator in the leading edge portion of the lithographic printing plate M.

After the trailing edge of the lithographic printing plate M passes through the activator coating mechanism 43, the pump 53 stops driving to stop the activator circulation (step S13). The supply of activator is terminated. If exposure of the next lithographic printing plate M has already been started, the circulation of the activator is continued.

For instance, the development unit 3 for developing the lithographic printing plate M having a width of 414 mm supplies the activator in an amount ranging from 30 to 60 ml/min. (e.g., 50 ml/min.) to the activator supply pipe 122 during the coating of the lithographic printing plate M with the activator. The large amount of activator in the step S8 is preferably not less than three times the amount of activator supplied to the activator supply pipe 122 during the coating of the lithographic printing plate M with the activator, that is, not less than 100 ml/min. (e.g., 220 ml/min.).

The supply of stabilizer in the stabilization portion 33 is similar in operation to the supply of activator. Although the activator coating mechanism 43 of the development portion 32 employs the backup roller 128 as a support member, the stabilizer coating mechanism 73 of the stabilization portion 33 employs the plate spring 138 as a support member, preventing the stabilization processing unevenness resulting from the shortage of the puddle of stabilizer formed between the coating roller 135 and the plate spring 138 in the stabilizer coating mechanism 73.

In this preferred embodiment, the amount of activator for circulation is changed before the leading edge of the lithographic printing plate M reaches the puddle of activator formed between the coating roller 125 and the backup roller 128 and is coated with the activator. However, the length of time T3 may be controlled so that the amount of activator for circulation is changed after slight time has elapsed since the leading edge of the lithographic printing plate M reaches the puddle of activator formed between the coating roller 125 and the backup roller 128 and starts being coated with the activator. In effect, the large amount of activator should be previously circulated prior to at least the start of coating of the lithographic printing plate M with the activator.

F. Numeric Examples regarding Silver Sludge Removal Effect

Description is given on numeric examples indicative of effects in the application of the present invention to the lithographic printing plate using the silver complex salt diffusion transfer reverse method.

The development unit 3 constructed as shown in FIGS. 2 through 8 was produced. The coating roller 125 used herein was a metal roller having a length of 460 mm and a diameter of 12 mm with a 0.4-mm-diameter wire wound around the metal roller. The backup roller 128 used herein was 460 mm in length and 25 mm in diameter and had a spongy surface containing a large number of separate pores and made of nitrile butadiene rubber (NBR) having a hardness of 25 degrees specified by JIS, which is within the hardness of 25 to 26 in ISO, ASTM and DIN. The circumferential velocity of the coating roller 125 was 0.65 times that of the backup roller 128. The feed velocity of the lithographic printing plate M was 20 mm/sec., and the amount of activator applied to the photosensitive surface of the lithographic printing plate M was 35 g/m$^2$. The lithographic printing plate M was 414 mm wide and 500 mm long and was comprised of a polyester film substrate, an anti-halation layer on the polyester film substrate, a silver halide emulsion layer on the anti-halation layer, and a physical development nuclei layer on top surface. A succession of 300 lithographic printing plates M (about 60 m$^2$) were developed. The temperature of the activator was 30° C.

Deposition of silver sludge and the like on the coating roller 125 was not observed by the naked eyes after development. The amount of activator applied to the photosensitive surface of the lithographic printing plate M by the coating roller 125 maintained 35 g/m$^2$ which was the initially set value.

The first and three hundredth lithographic printing plates M produced in the above described procedure were set to an offset printing press. A desensitization fluid was applied over the reverse sides of the two lithographic printing plates M, and prints were made using a humidity fluid. The results of the prints showed no significant difference between the first and three hundredth lithographic printing plates M and indicated a sufficiently improved plate life.

The results obtained when the circumferential velocity of the coating roller 125 was 1.5 times that of the backup roller 128 under the above described conditions were the same as the results obtained when the circumferential velocity of the coating roller 125 was 0.65 times that of the backup roller 128.

On the other hand, 300 lithographic printing plates M were developed under the above described conditions except that the circumferential velocity of the coating roller 125 equaled that of the backup roller 128. As a result, a large amount of silver sludge and the like was observed on the coating roller 125 after the development, and whitish contaminants were deposited thereon at several positions. The amount of activator applied to the photosensitive surfaces of the lithographic printing plates M by the coating roller 125 was 22 g/m$^2$ which was much less than the initial set value of 35 g/m$^2$ and also less than the minimum value required for development that is 30 g/m$^2$.

The first and three hundredth lithographic printing plates M produced in the above described procedure were set to the offset printing press, and prints were made under the above described conditions. As a result, the three hundredth lithographic printing plate M was not sufficiently developed and indicated an inferior plate life to the first lithographic printing plate.

G. Other Preferred Embodiments

In the above described preferred embodiments, the lithographic printing plate M using the silver complex salt diffusion transfer reverse method (DTR method) is used as the photosensitive material. The present invention, however, may be applied to a variety of other photosensitive materials having a photosensitive surface susceptible to damages, for example, photosensitive materials coated with a processing liquid such as the activator in the previous process step to have a swelled photosensitive film.

Various improvements described about the activator supply mechanism 43 may be applied to the stabilizer supply mechanism 73, and vice versa.

The porous elastic member used for the surface of the coating roller 136 may be of such a material as rubber having a surface formed with a multiplicity of pores, for example.

The present invention may be applied to an activator supply unit for directly supplying the activator from the activator discharge tube 122 to the lithographic printing plate M.

The apparatus of the present invention may adopt an activator supply system such that an activator recovery line is provided for connection between the activator tank 52 and an end of the activator supply pipe 122 opposite from the end connected to the tube 161 and the activator is partially discharged from the discharge holes 121 while being circulated.

Figure 21:
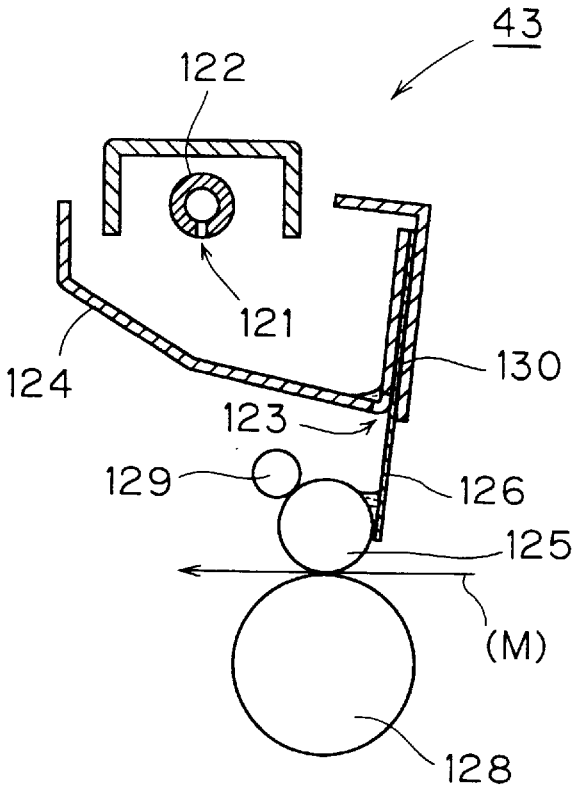
FIG. 21 is a schematic view of a modification of the activator coating mechanism.

Referring to FIG. 21, the anti-backflow roller 129, in place of the anti-backflow film 127 (FIG. 4), may be provided for rotating in contact with the coating roller 125 to serve as the restriction means. However, the arrangement of the above described preferred embodiments wherein the anti-backflow film 127 is attached to the activator receiving portion 124 enables the anti-backflow film 127 to be attached/detached and positioned integrally with the activator receiving portion 124, facilitating the maintenance of the activator coating mechanism 43.

The coating roller 125 may be of various types having a roughened or embossed surface with protrusions and recesses which is capable of metering the processing liquid, for example, a threaded roller and a grooved roller.

In the above described preferred embodiments, the surface of the backup roller 128 is made of sponge containing a large number of separate pores. The sponge may enter the plurality of grooves defined by the wire 125*b* on the surface of the coating roller 125 to remove the silver sludge and the like and prevent the activator contacting the surface of the backup roller 128 from entering the inside of the backup roller 128. The hardness of the sponge of the backup roller 128 is preferably 10 to 40 degrees specified by JIS-C which is the Japanese Industrial Standards regarding the hardness of foamed rubber. The range 10 to 40 degrees of the hardness corresponds to the range of hardness of: 11.3 to 41.8 degrees in ISO and ASTM; and 10 to 40 degrees in DIN. The roller is worn remarkably when the hardness is less than about 10 degrees in JIS, ISO, ASTM and DIN. It is difficult to remove the silver sludge and the like in the grooves of the coating roller 125 when the hardness is greater than about 40 degrees in JIS, ISO, ASTM and DIN. Preferably, the material of the surface of the backup roller 128, if other than sponge, has a hardness corresponding to the above described hardness.

One of the coating roller 125 and backup roller 128 may be held stationary, or both of the rollers 125 and 128 may rotate in the same direction. However, the coating roller 125 and the backup roller 128 preferably rotate in opposite directions in terms of feeding property of the lithographic printing plate M. In this case, the circumferential velocity of the coating roller 125 is preferably not more than 0.9 times or not less than 1.1 times the circumferential velocity of the backup roller 128 in terms of silver sludge removal performance, thereby providing the circumferential velocity ratio of not less than 10% between the rollers 125 and 128. In the above described preferred embodiments, since the circumferential velocity of the backup roller 128 is equal to the feed velocity of the lithographic printing plate M fed in the activator coating mechanism 43, it is preferred that the circumferential velocity of the coating roller 125 is not more than 0.9 times or not less than 1.1 times the feed velocity of the lithographic printing plate M. However, the excessively increased circumferential velocity of the coating roller 125 causes the development unevenness due to foaming of the activator. It is, therefore, preferred that the circumferential velocity of the coating roller 125 is not more than five times the feed velocity of the lithographic printing plate M.

Although an elastic tube 191 (FIG. 7) is provided in the whole of the pipe line between the pump 53 and the activator supply pipe 122, only a portion of the pipe line may be made of an elastic material.

H. Advantage of the Present Apparatus

The apparatus according to the preferred embodiments of the present invention is advantageous in the following points:

The surface of the coating roller in contact with the photosensitive material includes the elastic member to prevent damages to the surface of the photosensitive material. Further, since the photosensitive material is coated with the processing liquid passed through the opening formed between the coating roller having the porous surface and the contact member having the uneven surface as the coating roller is rotated, the processing liquid may be uniformed applied to the photosensitive material. In addition, the porous elastic member on the surface of the coating roller meters the processing liquid applied to the photosensitive material, permitting the coating of the photosensitive material with a correct amount of processing liquid.

The support member which is the elastic plate-like member may be of simple construction. The support member is formed with a hole for flowing therethrough an excess amount of processing liquid supplied to between the coating roller and the support member, preventing excessive growth of the puddle of processing liquid formed between the coating roller and the support member.

The surface of the coating roller is made of sponge containing a large number of separate pores to prevent the processing liquid contacting the surface from entering the inside of the coating roller.

The resistance portion for causing a pressure loss of the processing liquid passing therethrough is provided between the processing liquid discharge holes and the pulsation pump, and the processing liquid supply line between the pulsation pump and the resistance portion has a partial elastic line. Then, the pulsating flow of the processing liquid produced by the pulsation pump may be absorbed by the elastic line. This prevents air from entering the processing liquid discharge portion when the pulsation pump is used, to prevent an air bubble from blocking the processing liquid discharge holes of the processing liquid discharge portion, permitting uniform supply of the processing liquid.

The apparatus comprises the first processing liquid diffusion portion for diffusing the processing liquid supplied from the processing liquid supply portion and for causing the processing liquid to flow downwardly, and the second processing liquid diffusion portion including the contact member in contact with the coating member for diffusing the downward flow of the processing liquid between the coating member and the contact member and for causing the processing liquid to flow downwardly through the coating member. The processing liquid supplied from the processing liquid supply portion is diffused in two stages and then applied to the photosensitive material. This achieves uniform coating of the photosensitive material with the processing liquid when the photosensitive material is to be coated with a small amount of processing liquid.

Since the coating member includes the coating roller having a roughened surface, the processing liquid may be correctly metered and applied to the photosensitive material as the coating roller rotates.

Since the capability of the second processing liquid diffusion portion to diffuse the processing liquid is greater than the capability of the first processing liquid diffusion portion to diffuse the processing liquid. Thus, the uniformed processing liquid flowing downwardly from the second processing liquid diffusion portion may be applied to the photosensitive material.

The total cross-sectional area of the openings of the first processing liquid diffusion portion s greater than the total cross-sectional area of the openings of the second processing liquid diffusion portion. Thus, the uniformed processing liquid flowing downwardly from the second processing liquid diffusion portion may be applied to the photosensitive material.

The first processing liquid diffusion portion includes the processing liquid receiving portion having a plurality of openings bored for passage of the processing liquid therethrough. The processing liquid supplied from the processing liquid supply portion is diffused to the plurality of openings and then flows downwardly from the plurality of openings. This achieves the uniform coating of the photosensitive material with the processing liquid using a simple structure.

The plurality of openings of the processing liquid receiving portion are bored in positions different from the positions to which the processing liquid flows down from the openings of the processing liquid supply portion to the processing liquid receiving portion. Thus, the processing liquid supplied from the openings of the processing liquid supply portion is received by the processing liquid receiving portion and then flows downwardly from the openings of the processing liquid receiving portion. The processing liquid may be diffused and then uniformly coat the photosensitive material by using a simple structure.

The plurality of openings of the processing liquid receiving portion are bored on respective opposite sides of the positions to which the processing liquid flows down from the openings of the processing liquid supply portion to the processing liquid receiving portion. A stream of processing liquid flowing downwardly from each opening of the processing liquid supply portion is distributed between the openings of the processing liquid receiving portion which are bored on opposite sides of the position to which the stream of processing liquid flows down. Thereafter, the processing liquid flows downwardly from the openings of the processing liquid receiving portion. The processing liquid may be diffused and then uniformly coat the photosensitive material by using a simple structure.

The contact member is in elastic contact with the coating member. This allows the uniform diffusion of the processing liquid between the coating member and the contact member.

The restriction means for preventing the processing liquid flowing down from the first processing liquid diffusion portion from flowing back in the feed direction of the photosensitive material may effectively prevent the processing liquid flowing down from the first processing liquid diffusion portion from being deposited again on the photosensitive material coated with the processing liquid by the coating member and to be fed.

The amount of processing liquid supplied to the coating roller until the leading edge of the photosensitive material reaches a puddle of processing liquid formed between the coating roller and the support member is greater than the amount of processing liquid supplied to the coating roller while the photosensitive material is coated with the processing liquid. This forms the puddle of processing liquid having a sufficient volume required for processing to prevent processing unevenness resulting from the shortage of the amount of the processing liquid in the leading edge portion of the photosensitive material.

The amount of temperature-controlled processing liquid circulated before the processing liquid coating portion coats the photosensitive material with the processing liquid is greater than the amount of processing liquid circulated when the photosensitive material is coated with the processing liquid. Thus, the processing liquid at a suitable temperature may be applied to the photosensitive material from the start of the coating of the photosensitive material with the processing liquid. This prevents the processing unevenness resulting from low temperatures of the processing liquid.

The amount of processing liquid circulated until the leading edge of the photosensitive material reaches a puddle of processing liquid formed between the coating roller and the support member is greater than the amount of processing liquid circulated while the photosensitive material passes through the puddle of processing liquid. This forms the puddle of processing liquid having a sufficient volume required for processing to prevent processing unevenness resulting from the shortage of the amount of the processing liquid in the leading edge portion of the photosensitive material. In addition, the processing liquid at a suitable temperature may be applied to the photosensitive material from the start of the coating of the photosensitive material with the processing liquid. This prevents the processing unevenness resulting from low temperatures of the processing liquid.

The amount of processing liquid circulated through the circulation passage until the photosensitive material with an image recorded thereon by an image recording portion and fed by a feed mechanism reaches the processing liquid coating portion is greater than the amount of processing liquid while the processing liquid coating portion applies the processing liquid to the photosensitive material fed by the feed mechanism. Thus, the processing liquid at a suitable temperature may be applied to the photosensitive material from the start of the coating of the photosensitive material with the processing liquid. This prevents the processing unevenness resulting from low temperatures of the processing liquid.

The circumferential velocity of the coating roller differs from that of the backup roller. Then, the surface of the coating roller is wiped off at all times by the backup roller, which prevents silver sludge and the like from being deposited on the roughened surface of the coating roller. This maintains a constant amount of processing liquid applied by the coating roller having the roughened surface and facilitates maintenance.

The coating roller and the backup roller are rotated in opposite directions, and the circumferential velocity of the coating roller is not more than 0.9 times or not less than 1.1 times the circumferential velocity of the backup roller. This prevents the silver sludge and the like from being deposited on the coating roller without impairing the feeding properties of the photosensitive material.

The surface of the backup roller is made of sponge which enters the recess in the roughened surface of the coating roller to ensure the cleaning of the roughened surface of the coating roller, preventing the silver sludge from being deposited thereon.

The hardness of the surface of the backup roller is 10 to 40 degrees in JIS and DIN or 11.3 to 41.8 degrees in ISO and ASTM which allows the sponge portion to enter the recess in the roughened surface of the coating roller to ensure the cleaning of the roughened surface of the coating roller, preventing the silver sludge from being deposited thereon.

The diameter ratio between the coating roller and the backup roller differs from the gear velocity ratio therebetween. The coating roller and the backup roller are rotated at different circumferential velocities. Therefore, the difference in circumferential velocity between the coating and backup rollers may be controlled at a given value with a simple structure.

The pitch circles of the first and second gears are spaced a distance apart from each other, the distance being less than the sum of the addendums of the first and second gears. The generation of a clearance between the coating roller and the backup roller may be delayed when the contour of the backup roller is decreased due to wear thereof. This provides for the long-term use of the backup roller.

The first gear coupled to the driving shaft of the coating roller is in meshing engagement with the third gear coupled through drive transfer means to the second gear coupled to the driving shaft of the backup roller to transfer the driving force. In addition, the third gear is located laterally relative to the first gear. The generation of a clearance between the coating roller and the backup roller may be delayed when the contour of the backup roller is decreased due to wear thereof. This provides for the long-term use of the backup roller.

The distance over which the photosensitive material is fed per second is in the range from 1.1 times to 2.5 times the diameter of the coating roller. This forms a moderate puddle of processing liquid between the coating roller and the photosensitive material to achieve even and stable processing of the photosensitive material when a small amount of processing liquid is used. The processing liquid which does not coat the photosensitive material but is recovered is not fatigued.

The diameter of the backup roller is not less than 1.25 times the diameter of the coating roller. This previously forms a moderate puddle of processing liquid between the coating roller and the backup roller. Even and stable processing of the photosensitive material may be performed particularly in the leading edge portion of the photosensitive material when a small amount of processing liquid is used.

The distance over which the photosensitive material is fed per second is in the range of 1.1 times to 2.5 times the diameter of the coating roller, and the diameter of the backup roller is not less than 1.25 times the diameter of the coating roller. This achieves even and stable processing of the entire photosensitive material when a small amount of processing liquid is used.

The diameter of the coating roller is not more than 30 mm which permits the processing liquid to coat the photosensitive material particularly accurately.

While the invention has been described in detail, the foregoing description is in all aspects illustrative and not restrictive. It is understood that numerous other modifications and variations can be devised without departing from the scope of the invention.

We claim:

1. An apparatus for processing a photosensitive material, comprising:

a processing liquid discharge pipe for discharging a processing liquid to a predetermined low path;

a coating roller for receiving said processing liquid from said flow path to coat said photosensitive material with said processing liquid;

first processing liquid diffusion means provided in said flow path for receiving said processing liquid from said processing liquid discharge pipe to diffuse said processing liquid and to cause said processing liquid to flow downwardly; and second processing liquid diffusion means having a contact member in contact with said coating roller for receiving said processing liquid from said first processing liquid diffusion means to diffuse said processing liquid again and to cause said processing liquid to flow downwardly along said coating roller;

wherein said coating roller has a circumferential surface on which a plurality of grooves are formed along a circumferential direction of said coating roller, and wherein said processing liquid flows downwardly through said plurality of grooves.

2. The apparatus according to claim 1, wherein said first processing liquid diffusion means comprises a processing liquid receiving member through which a plurality of through holes are formed, wherein said processing liquid flows downwardly through said plurality of through holes, and wherein said plurality of through holes are arranged at a pitch greater than a pitch at which said plurality of grooves are arranged.

3. The apparatus according to claim 2, wherein the sum of the cross-sectional areas of said plurality of through holes is greater than the sum of the cross-sectional areas of said plurality of grooves.

4. The apparatus according to claim 1, further comprising:

anti-backflow means in contact with said coating roller for preventing said processing liquid from flowing against rotation of said coating roller.

5. The apparatus according to claim 1, further comprising:

a backup roller opposed to said coating roller, said photosensitive material being fed between said coating roller and said backup roller, wherein said backup roller rotates at a circumferential velocity different from a circumferential velocity at which said coating roller rotates.

6. The apparatus according to claim 5, wherein said backup roller is a sponge roller.

7. The apparatus according to claim 5, wherein a distance over which said photosensitive material is fed per second is selected in a range from 1.1 to 1.25 times the diameter of said coating roller.

8. The apparatus according to claim 5, wherein the diameter of said backup roller is not less than 1.25 times the diameter of said coating roller.

9. An apparatus for processing a photosensitive material, comprising:

a processing liquid discharge pipe for discharging a processing liquid to a predetermined low path;

a coating roller for receiving said processing liquid from said flow path to coat said photosensitive material with said processing liquid;

first processing liquid diffusion means provided in said flow path for receiving said processing liquid from said processing liquid discharge pipe to diffuse said processing liquid and to cause said processing liquid to flow downwardly; and second processing liquid diffusion means having a contact member in contact with said coating roller for receiving said processing liquid from said first processing liquid diffusion means to diffuse said processing liquid again and to cause said processing liquid to flow downwardly along said coating roller;

wherein said processing liquid discharge pipe discharges a first amount of said processing liquid per second until a leading edge of said photosensitive material reaches said coating roller, and wherein said processing liquid discharge pipe discharges a second amount of said processing liquid per second while said processing liquid is applied to said photosensitive material after said leading edge of said photosensitive material reaches said coating pipe, said first amount of said processing liquid being greater than said second amount of said processing liquid.

10. The apparatus according to claim 9, further comprising:

a processing liquid tank for storing and processing liquid;

a pipe line through which said processing liquid from said processing liquid tank is supplied;

a pulsation pump coupled to said pipe line; and a resistance member mounted in said pipe line between said pulsation pump and said processing liquid discharge pipe for causing a pressure loss of said processing liquid passing through said pipe line, wherein said processing liquid discharge pipe has a plurality of processing liquid discharge holes formed therein for discharging said processing liquid delivered from said pipe line through said plurality of processing liquid discharge holes; and wherein at least a portion of said pipe line between said pulsation pump and said resistance member has elasticity.

11. An apparatus for processing a photosensitive material, comprising:

processing liquid discharge pipe for discharging a processing liquid;

a coating roller having a rough surface for contacting a photosensitive surface of said photosensitive material to apply said processing liquid to said photosensitive surface;

an elastic contact member in contact with said coating roller;

processing liquid supply means for supplying said processing liquid to a contact space between said coating roller and said contact member to form a puddle of processing liquid between said contact space, said puddle of processing liquid extending in an axial direction of said coating roller; and a backup roller opposed to said coating roller for contacting a photosensitive surface of said photosensitive material, said photosensitive material being held between said coating roller and said backup roller.

12. The apparatus according to claim 11, wherein said backup roller is a sponge roller, and wherein said backup roller rotates at a circumferential velocity different from a circumferential velocity at which said coating roller rotates.

13. The apparatus according to claim 11, wherein a distance over which said photosensitive material is fed per second is selected in a range from 1.1 to 1.25 times the diameter of said coating roller.

14. The apparatus according to claim 11, wherein the diameter of said backup roller is not less than 1.25 times the diameter of said coating roller.

15. The apparatus according to claim 11, wherein said processing liquid supply means discharges a first amount of said processing liquid per second until a leading edge of said photosensitive material reaches said coating roller, and wherein said processing liquid supply means discharges a second amount of said processing liquid per second while said processing liquid is applied to said photosensitive material after said leading edge of said photosensitive material reaches said coating roller, said first amount of said processing liquid being greater than said second amount thereof.

16. The apparatus according to claim 15, further comprising:

a processing liquid tank for storing said processing liquid therein;

a pipe line for supplying said processing liquid from said processing liquid tank;

a pulsation pump coupled to said pipe line; and a resistance member mounted in said pipe line between said pulsation pump and said processing liquid discharge pipe for causing a pressure loss of said processing liquid passing through said pipe line;

wherein said processing liquid discharge pipe has a plurality of processing liquid discharge holes formed therein for discharging said processing liquid delivered from said pipe line through said plurality of processing liquid discharge holes; and wherein at least a portion of said pipe line between said pulsation pump and said resistance member has elasticity.

17. An apparatus for processing a photosensitive material, comprising:

a coating roller in contact with a photosensitive surface of said photosensitive material for applying a processing liquid to said photosensitive surface;

a contact member having an uneven surface which has ups and downs in an axial direction of said coating roller and in contact with said coating roller;

processing liquid supply means for supplying said processing liquid to a contact space between said coating roller and said contact member; and support means opposed to said coating roller and in contact with a photoinsensitive surface of said photosensitive material for supporting said photoinsensitive surface.

18. The apparatus according to claim 17, wherein at least a surface of said coating roller includes a porous elastic member.

19. The apparatus according to claim 18, wherein said elastic member is a plate-like member having a hole for flowing an excess amount of said processing liquid therethrough.

* * * * *